US009081359B2

(12) United States Patent
Hoashi et al.

(10) Patent No.: US 9,081,359 B2
(45) Date of Patent: Jul. 14, 2015

(54) IMAGE FORMING APPARATUS AND PROCESS CARTRIDGE

(71) Applicant: CANON KABUSHIKI KAISHA, Tokyo (JP)

(72) Inventors: Shigeru Hoashi, Numazu (JP); Masaki Sato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/451,555

(22) Filed: Aug. 5, 2014

(65) Prior Publication Data

US 2015/0055974 A1 Feb. 26, 2015

(30) Foreign Application Priority Data

Aug. 20, 2013 (JP) ..... 2013-170304

(51) Int. Cl.
*G03G 21/18* (2006.01)

(52) U.S. Cl.
CPC ..... *G03G 21/1842* (2013.01); *G03G 21/1807* (2013.01)

(58) Field of Classification Search
CPC ..... G03G 21/1807; G03G 21/1821; G03G 21/1842; G03G 21/1853
See application file for complete search history.

(56) References Cited

U.S. PATENT DOCUMENTS 7,567,769 B2 7/2009 Noguchi et al.
7,860,433 B2 * 12/2010 Toba et al. ..... 399/111
8,260,171 B2 * 9/2012 Matsuda ..... 399/110
8,452,208 B2 5/2013 Kikuchi
8,768,210 B2 7/2014 Hoashi
8,862,022 B2 10/2014 Sato et al.
2012/0269543 A1 * 10/2012 Hashimoto ..... 399/111
2012/0328331 A1 12/2012 Sato
2014/0147158 A1 5/2014 Fujinaka et al.
2014/0161483 A1 6/2014 Fukui et al.

FOREIGN PATENT DOCUMENTS

JP 2008-165027 A 7/2008

OTHER PUBLICATIONS

Masaki Sato, U.S. Appl. No. 14/454,870, filed Aug. 8, 2014.

* cited by examiner

*Primary Examiner* — Gregory H Curran
(74) *Attorney, Agent, or Firm* — Fitzpatrick, Cella, Harper & Scinto

(57) ABSTRACT

An image forming apparatus, having process cartridges each including a photosensitive drum and a developing roller, includes a movable member movable between an inside and an outside of a main assembly of the image forming apparatus in a movement direction crossing a longitudinal direction of the photosensitive drum, and a mounting portion for supporting the process cartridges, wherein the process cartridges are detachably mountable to the mounting portion from a direction crossing the longitudinal direction and the movement direction. In addition, and an interrelating member, movable in interrelation with movement of the movable member, moves the developing roller relative to the photosensitive drum so that a distance between a rotation center of the photosensitive drum and a rotation center of the developing roller is decreased with respect to the movement direction when the movable member is moved from the inside to the outside of the main assembly.

11 Claims, 19 Drawing Sheets

(a)

(b)

(a)

(b)

(a)

(b)

(c)

(a)

(b)

(a)

(b)

(a)

(b)

(c)

IMAGE FORMING APPARATUS AND PROCESS CARTRIDGE

FIELD OF THE INVENTION AND RELATED ART

The present invention relates to an image forming apparatus, to which a plurality of process cartridges are detachably mountable, for forming a color image on a recording material (medium), and relates to the process cartridge.

Here, the image forming apparatus is an apparatus for forming the image on the recording material by using an image forming process. The image forming apparatus includes, e.g., a copying machine, a printer (a laser (beam) printer, an LED printer, or the like), a facsimile machine, an image display apparatus (electronic blackboard or electronic white board) and the like. On the recording material, the image is formed by the image forming apparatus, and the recording material may include, e.g., a sheet, an OHT sheet, an intermediary transfer member, an image displaying material, and the like.

Mounting and dismounting of the process cartridge relative to the image forming apparatus will be described. In an electrophotographic image forming apparatus in which a plurality of process cartridges are arranged in a substantially horizontal direction and are detachably mountable to the apparatus main assembly, in order to facilitate mounting and dismounting of the process cartridges, a constitution in which the plurality of the process cartridges are pulled out as a unit and then are detachably mountable in a vertical direction has been proposed (Japanese Laid-Open Patent Application (JP-A) 2008-165027 corresponding to U.S. Pat. No. 7,567,769).

In the image forming apparatus having the pulling-out constitution such that a pulling-out portion (tray) supporting the plurality of process cartridges is capable of being pulled out to an outside of the image forming apparatus, when a pitch between adjacent drums is narrowed in order to shorten FPOT (first print-out time), parts (components) of adjacent process cartridges are disposed in an overlapping manner in some cases. In such cases, it can be difficult to ensure a mounting locus along which an intended process cartridge is detachably mountable in the vertical direction.

Here, the FPOT is a time until a first recording material on which the image is formed is discharged. The drum is a photosensitive drum.

SUMMARY OF THE INVENTION

A principal object of the present invention is to realize a state in which even under a condition such that adjacent two cartridges partly overlap with each other at an image formable position inside an apparatus main assembly of an image forming apparatus, a movable member for supporting the cartridges is pulled out to an outside of the apparatus main assembly to make the cartridges detachably mountable to the movable member. As a result, there is provided an image forming apparatus capable of improving usability and also capable of not only shortening FPOT but also downsizing the image forming apparatus.

According to an aspect of the present invention, there is provided an image forming apparatus, capable of forming a color image on a recording material, to which a plurality of process cartridges, each of which includes a photosensitive member unit including a photosensitive drum and each of which includes a developing unit which includes a developing roller actable on the photosensitive drum and which is movable relative to the photosensitive member unit, the image forming apparatus comprising: a movable member movable between an inside and an outside of a main assembly of the image forming apparatus in a movement direction crossing a longitudinal direction of the photosensitive drum in a state in which the plurality of process cartridges are supported; a mounting portion, provided in the movable member, for supporting the plurality of process cartridges, wherein the plurality of process cartridges are detachably mountable to the mounting portion from a direction crossing the longitudinal direction and the movement direction; and an interrelating member, movable in interrelation with movement of the movable member, for moving the developing unit relative to the photosensitive member unit so that a distance between a rotation center of the photosensitive drum and a rotation center of the developing roller is decreased with respect to the movement direction when the movable member is moved from the inside to the outside of the main assembly.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiment 1

Embodiment 1 of the present invention will be described with reference to FIGS. 1-12. Description will be made in the order of a general structure of an image forming apparatus, a mounting and dismounting method of a process cartridge, a structure of the process cartridge and a slide movement constitution of a cartridge.

In this embodiment, as the image forming apparatus, an electrophotographic laser beam printer capable of forming a color image on a recording material is illustrated. Further, as the image forming apparatus, an image forming apparatus in which respective color toner images on photosensitive drums are successively transferred onto a belt (intermediary recording medium) and then are collectively transferred from the belt onto a recording material as a final recording medium is illustrated.

In this embodiment, a position where an image is formed on the photosensitive drum in contact with an intermediary transfer belt is defined as an "image forming position". Further, a position where the photosensitive drum is spaced from the intermediary transfer belt and is movable toward an outside of the image forming apparatus is defined as an "inside position". Further, a position where a cartridge tray is pulled out and then a process cartridge is detachably mountable is defined as an "outside position".

(General Structure of Image Forming Apparatus)

Figure 1:
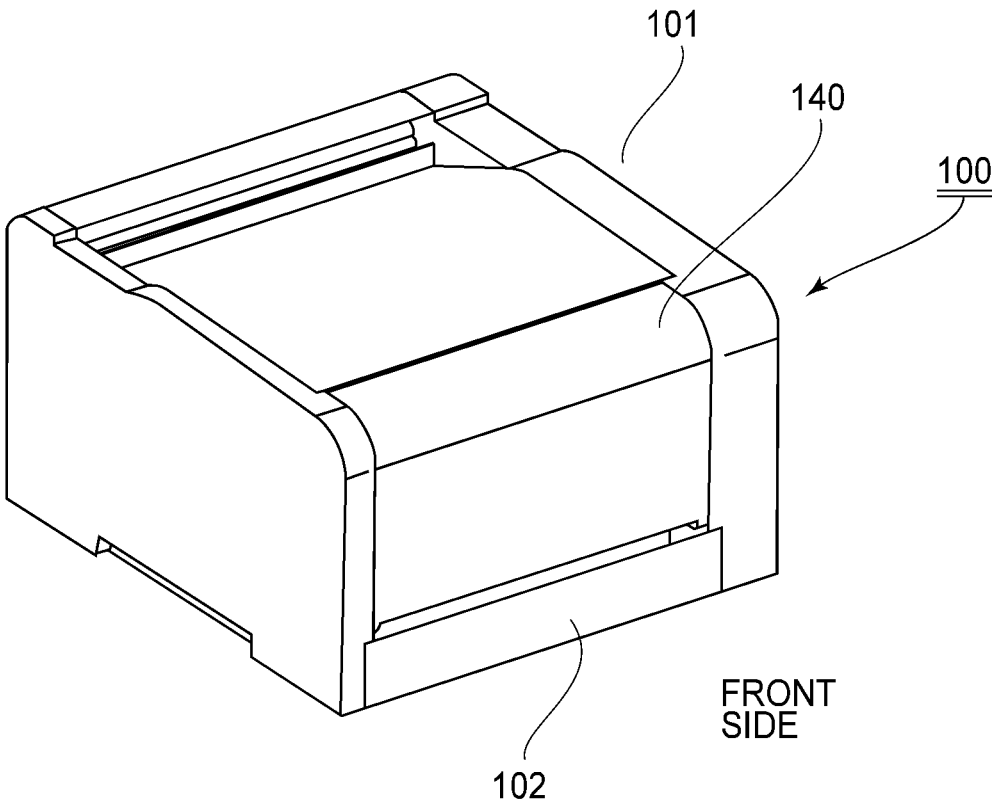
FIG. 1 is a perspective view of an outer appearance of an image forming apparatus in Embodiment 1.
Figure 2:
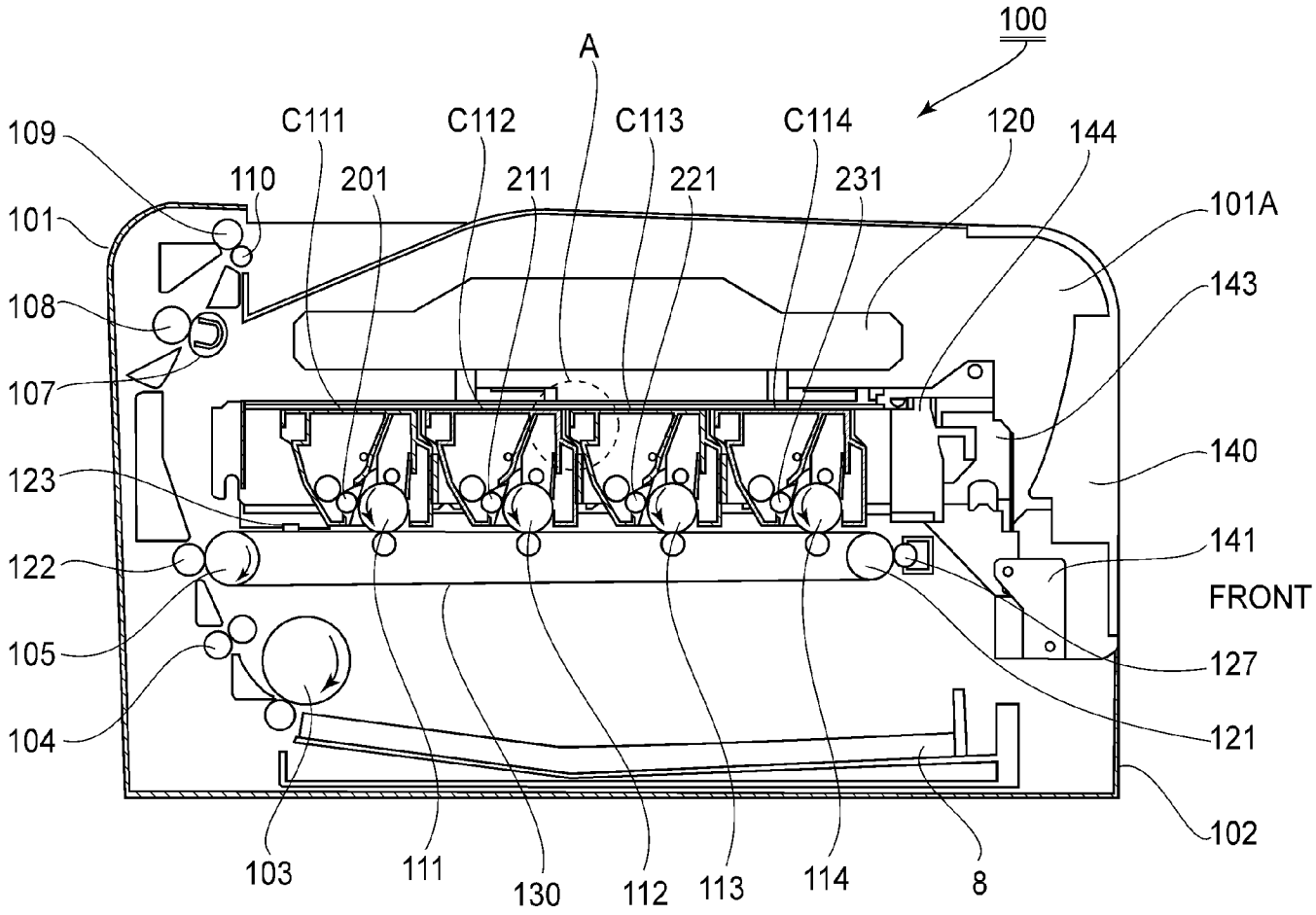
FIG. 2 is a longitudinal schematic side view of the image forming apparatus in a state in which a door is closed.

With reference to FIGS. 1 and 2, an outline of a general structure of an image forming apparatus 100 in this embodiment will be described. FIG. 1 is a perspective view of an outer appearance of the image forming apparatus 100. FIG. 2 is a longitudinal schematic side view of the image forming apparatus 100 in a state in which each of photosensitive drums is located at the image forming position where the photosensitive drum contacts the intermediary transfer belt.

In FIG. 2, a recording material 8 stacked and accommodated in a feeding tray 102 is fed by a feeding roller 103 rotating in the clockwise direction in the figure, and is sent to a conveying roller 104 and then is sent to a nip between an inner belt roller 105 and a transfer roller 122.

As image bearing members constituting a plurality of image forming portions, i.e., four image forming portions in this embodiment, photosensitive drums 111, 112, 113 and 114 rotate in the counterclockwise direction in FIG. 2. At each of the image forming portions, on an outer peripheral surface of an associated photosensitive drum, an electrostatic latent image is successively formed by laser light from a laser scanner 120 and then is developed by an associated one of developing rollers 201, 211, 221 and 231, so that a toner image is formed. The toner image formed on each of the photosensitive drums 111-114 is transferred onto an intermediary transfer belt 130.

The intermediary transfer belt 130 is extended and stretched between the inner belt roller 105 and a tension roller 121, and is circulated and driven by the inner belt roller 105 in the same direction as a rotational direction of the photosensitive drums at the substantially same peripheral speed as a rotational speed of the photosensitive drums.

In the case where a color image is formed, toner images of colors of yellow, magenta, cyan and black are formed and developed on the photosensitive drums 111-114, respectively, and then are successively transferred onto the intermediary transfer belt 130. Then, the toner images transferred (formed) on the intermediary transfer belt 130 are collectively transferred into the recording material 8 sent to the nip between the inner belt roller 105 and the transfer roller 122.

Further, the recording material 8 on which the toner images are transferred is sent to a nip between a fixing film 107 and a pressing roller 108, and is heated and pressed at the nip, so that the toner images are fixed on the recording material 8. The recording material 8 on which the toner images are fixed is discharged to an outside of the image forming apparatus by discharging rollers 109 and 110. A cleaning portion 127 for the intermediary transfer belt 130 is provided.

Here, at the image forming portions, the photosensitive drums 111, 112, 113 and 114 are assembled with process means actable thereon into units to constitute process cartridges C111, C112, C113 and C114, respectively. The process cartridges C111, C112, C113 and C114 are provided detachably mountable to an apparatus main assembly 101 of the image forming apparatus 100.

The process cartridge is prepared by integrally assembling, into a cartridge or a unit, the photosensitive drum as the image bearing member and at least one of a developing means as a process means actable on the photosensitive drum, and this cartridge is detachably mountable to the apparatus main assembly 101 of the image forming apparatus 100. Further, the photosensitive drum and, as the process means actable on the photosensitive drum, in addition to the developing means, a charging means and a cleaning means or the like are integrally assembled into the cartridge which is detachably mountable to the apparatus main assembly 101.

(Mounting and Dismounting Method of Contact)

Figure 3:
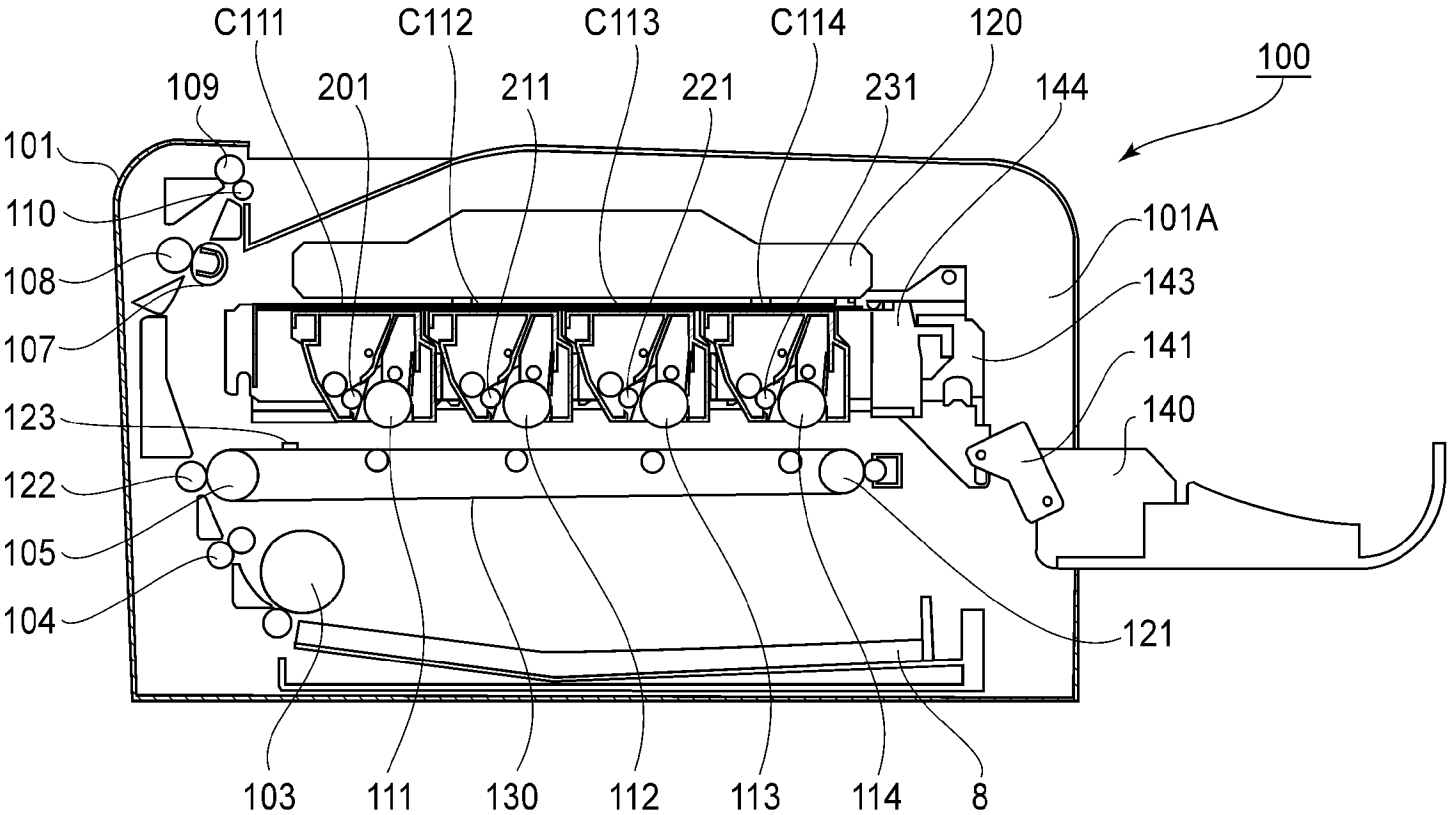
FIG. 3 is a longitudinal schematic side view of the image forming apparatus in a state in which the door is open.
Figure 4:
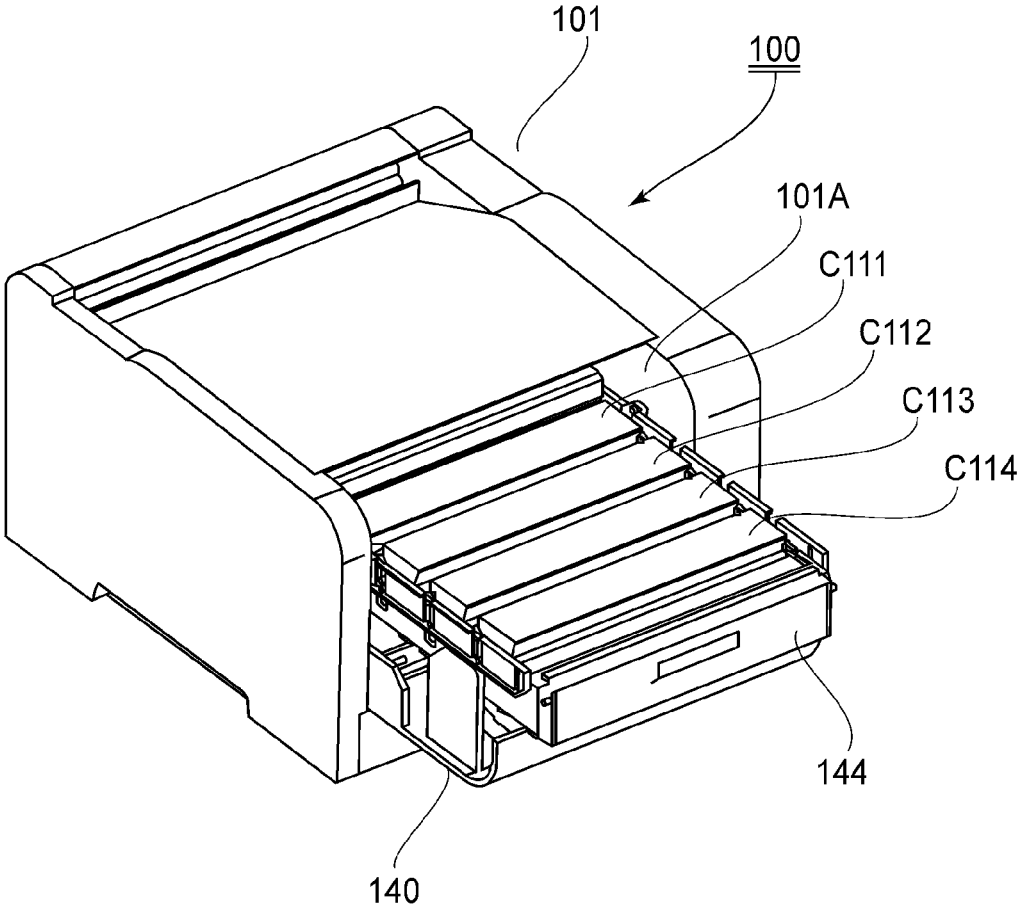
FIG. 4 is a perspective view of an outer appearance of the image forming apparatus in a state in which a cartridge tray is pulled out.

An outline of a mounting and dismounting method of the process cartridge will be described with reference to FIGS. 3 and 4. FIG. 3 is a longitudinal schematic side view of the image forming apparatus 100 in a state in which a cartridge color (openable member) 140 is open. FIG. 4 is a perspective view of an outer appearance of the image forming apparatus in a state in which a cartridge tray 144 as a movable member is pulled out from an inside of the apparatus main assembly 101 to an outside of the apparatus main assembly 101 through an opening 101A which is exposed (opened).

Here, with respect to the image forming apparatus 100, a type of exchange (replacement) of the process cartridge is such that in order to improve usability, the cartridge is placed on the tray 144 of a pulling-out type and then is exchanged in a front access manner.

That is, the apparatus main assembly 101 is provided with the opening 101A in a front (surface) side. The opening 101A permits passing of the cartridge therethrough in order to insert the cartridge into the inside of the apparatus main assembly 101 and in order to dismount the cartridge to the outside of the apparatus main assembly 101. Further, the cartridge door 140 as the openable member for closing and opening the opening 101A is provided openably relative to the apparatus main assembly 101. In this embodiment, the cartridge door 140 is openable, closable and rotatable, relative to the apparatus main assembly 101, with respect to a rotatable member 141 provided in a lower side thereof.

Further, as shown in FIG. 4, the process cartridges C111, C112, C113 and C114 are roughly held by and detachably mountable to the cartridge tray 144 to be inserted into and pulled out from the apparatus main assembly 101. This cartridge tray 144 is horizontally held slidably and movably in a front-rear direction by a pair of tray holding members 143 provided on left and right frames, of the apparatus main assembly, constituting an apparatus main assembly frame. Here, a front direction is a direction in which the tray 144 is pulled out from the apparatus main assembly 101, and a rear direction is a direction in which the tray 144 is inserted into the apparatus main assembly.

The tray 144 is movable, in a state in which the tray 144 supports the above-described plurality of the process cartridges C111, C112, C113 and C114, between the inside and the outside of the apparatus main assembly 101 with respect to a movement direction crossing a longitudinal direction of the photosensitive drum of each of the process cartridges.

The tray holding members 143 are moved by predetermined amounts in the front direction and an upward direction in interrelation with an opening rotation of the cartridge door 140. By this positional movement of the tray holding members 143, also the cartridge tray 144 is moved upwardly, so that the photosensitive drums 111-114 are floated (spaced) from the intermediary transfer belt 130, so that the cartridge tray 144 is placed in a pullable-out state from the apparatus main assembly 101.

Figure 11:
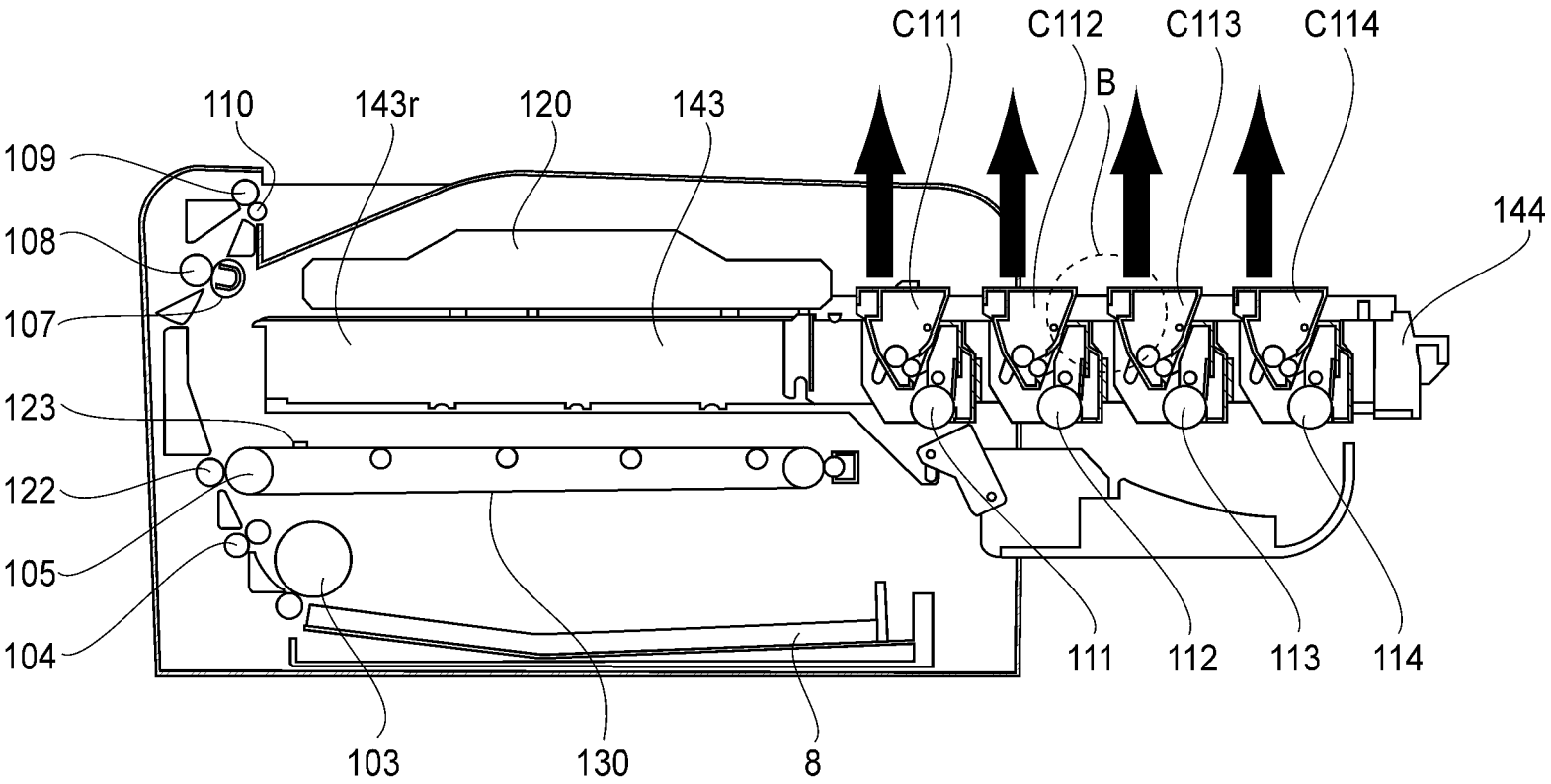
FIG. 11 is a longitudinal schematic side view of an image forming apparatus in a state in which the cartridge tray is pulled out.

As shown in FIGS. 4 and 11, when the cartridge tray 144 is pulled out from the inside to the outside of the apparatus main assembly 101, an upper surface of each of the process cartridges is exposed (opened). Further, as shown in FIG. 11 at a portion B, in interrelation with the pulling-out operation of the cartridge tray 144, a developing unit 156 (FIGS. 5 and 6) of each of the process cartridges slide-moves relative to a photosensitive member unit 151. As a result, of the process cartridges, adjacent two process cartridges can be placed in a state in which the process cartridges do not overlap with each other can be ensured, so that each of the process cartridges C111, C112, C113 and C114 is dismountable in an arrow direction.

A method of slide movement of the developing unit 156 relative to the photosensitive member unit 151 will be described later specifically. Further, when the process cartridges C111, C112, C113 and C114 are mounted in the apparatus main assembly 101, a reverse procedure is performed.

(Structure of Process Cartridge)

In this embodiment, the first to fourth process cartridges C111-C114 have the same non-contact developing method (jumping developing method) constitution. That is, with respect to each of the process cartridges, at the image forming position shown in FIG. 2, the developing roller 201 (211, 221, 231) is precisely fixed to the photosensitive drum 111 (112, 113, 114) in a state in which a small interval therebetween is ensured.

Figure 5:
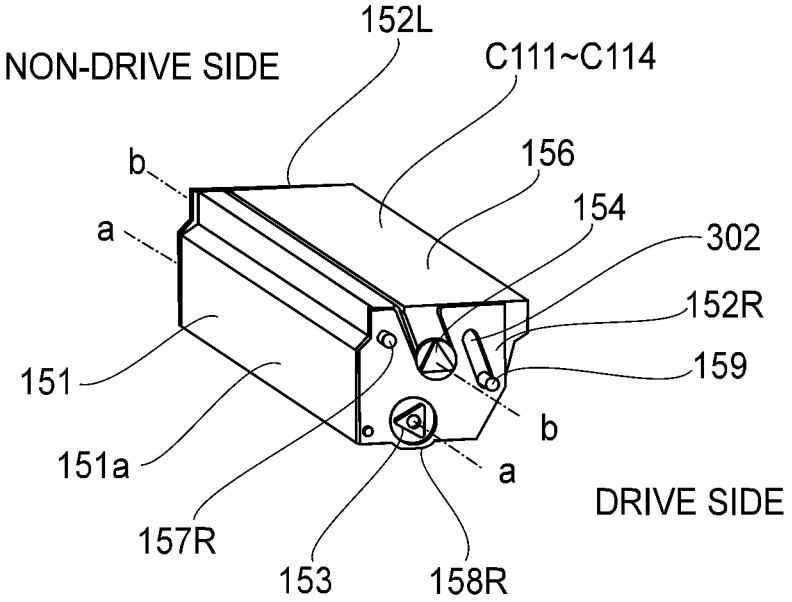
FIG. 5 is a perspective view of an outer appearance of a cartridge as seen from a driving side (drive side) in Embodiment 1.
Figure 6:
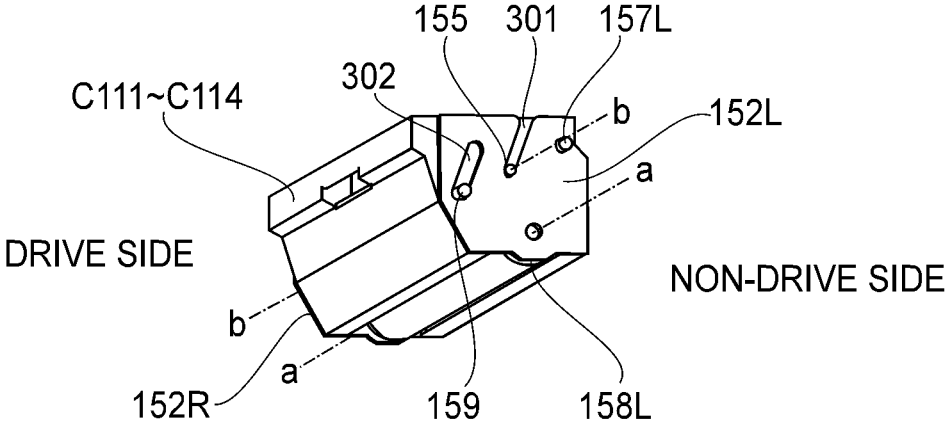
FIG. 6 is a perspective view of an outer appearance of the cartridge as seen from a non-driving side (non-drive side).

A general structure of each process cartridge will be described with reference to FIGS. 5 and 6. FIGS. 5 and 6 are perspective views of the process cartridge C (C111-C114) as seen from a driving side and a non-driving side, respectively. The process cartridge C is an elongated assembly having, as a longitudinal direction, a left-right direction which is an axial direction a-a of the photosensitive drum. Further, the process cartridge C includes a photosensitive member unit (charging unit) 151, a developing unit 56, a left side cover (non-driving side cover) 152L and a right side cover (driving side cover) 152R.

In this embodiment, the pitch (distance) between the photosensitive drums is decreased (narrowed) while ensuring a space of parts necessary to the process cartridge and a volume of the developer. For that reason, as shown in FIG. 2 at a portion A, at the image forming position, the photosensitive member unit (charging unit) 151 of one of adjacent cartridges and the developing unit 156 of the other cartridge are disposed so as to overlap with each other with respect to an up-down direction relative to the apparatus main assembly 101.

The left side cover 152 and the right side cover 152R are fixedly mounted from the outside of the photosensitive member unit 151 on a left side surface and a right side surface, respectively, of the photosensitive member unit 151. Each of the left and right side covers 152L and 152R includes an extended portion extended rearward from the photosensitive member unit 151. Further, the developing unit 156 is provided between the left and right extended portions.

The developing unit 156 is slidably movable relative to these extended portions of the left and right side covers (side frames) 152L and 152R with respect to an axis b-b, as a positioning reference (basis), parallel to the drum axis a-a. The positioning reference b-b of the developing unit 156 is aligned with a center of a developing roller driving coupling (second drive input portion, developing roller driving force receiving portion) 154 in the right side cover 152R side as the driving side. Further, in the left side cover 152L side as the non-driving side, the rotation center b-b is aligned with a center of a projection (projected portion) 155.

That is, a center axis of the coupling 154 and a center axis of the projection 155 are substantially aligned with each other, with respect to cross-sectional coordinates. Further, a projection (projected portion) 159 is formed so as to project from an associated one of the left and right side surfaces.

At a side surface portion of the process cartridge C in the driving side, a drum driving coupling (first drive input portion, drum driving force receiving portion) 153, the developing roller driving coupling 154, a driving side rotation preventing portion 157R and a driving side portion-to-be-supported (first portion-to-be-positioned) 158R are provided. A center of the drum coupling 153 is aligned with the drum axis a-a. At a side surface portion of the process cartridge C in the non-driving side, a non-driving side rotation preventing portion 157L and a non-driving side portion-to-be-supported (second portion-to-be-positioned) 158L are provided.

The driving side rotation preventing portion 157R and the non-driving side rotation preventing portion 157L are, as described later, engaged with engaging portions provided in the cartridge tray 144 side when the process cartridge C is inserted into the cartridge tray 144. Further, the rotation preventing portions 157R and 157L act as means for preventing rotation of the process cartridge C when the process cartridge is positioned relative to the apparatus main assembly 101. That is, the rotation preventing portions 157R and 157L prevent the process cartridge C from rotating when the process cartridge C receives the rotational driving force from the apparatus main assembly 101.

The first portion-to-be-positioned 158R provided in the driving side is an arcuate downward projection and is provided on a lower edge of the right side cover 152R so as to be coaxial with the drum. The second portion-to-be-positioned 158L provided in the non-driving side is also an arcuate downward projection and is provided on a lower edge of the left side cover 152L so as to be coaxial with the drum.

Incidentally, in interrelation with a closing operation of the cartridge door 140, with a lowering of the cartridge tray (movable member) 144 toward the intermediary transfer belt 130, each of the portions-to-be-positioned 158R and 158L is positioned at a main assembly-side positioning portion (not shown) in midstream of the lowering. At this time, in interrelation with the closing operation of the cartridge door 140, an unshown cartridge urging (pressing) member acts on an upper surface of the developing unit 156.

As a result, the developing unit 156 is precisely positioned relative to the photosensitive member unit 151 at positioning portions 301*a* and 301*b* of a slide guiding portion 301 (FIGS. 6 and 7) described later. At the same time, the portions-to-be-positioned (supported) 158R and 158L are engaged with the main assembly-side positioning portions (not shown) provided in the apparatus main assembly 101, and end a positioning step of the process cartridge C at the accommodating portion (image forming portion) in the apparatus main assembly.

Figure 7:
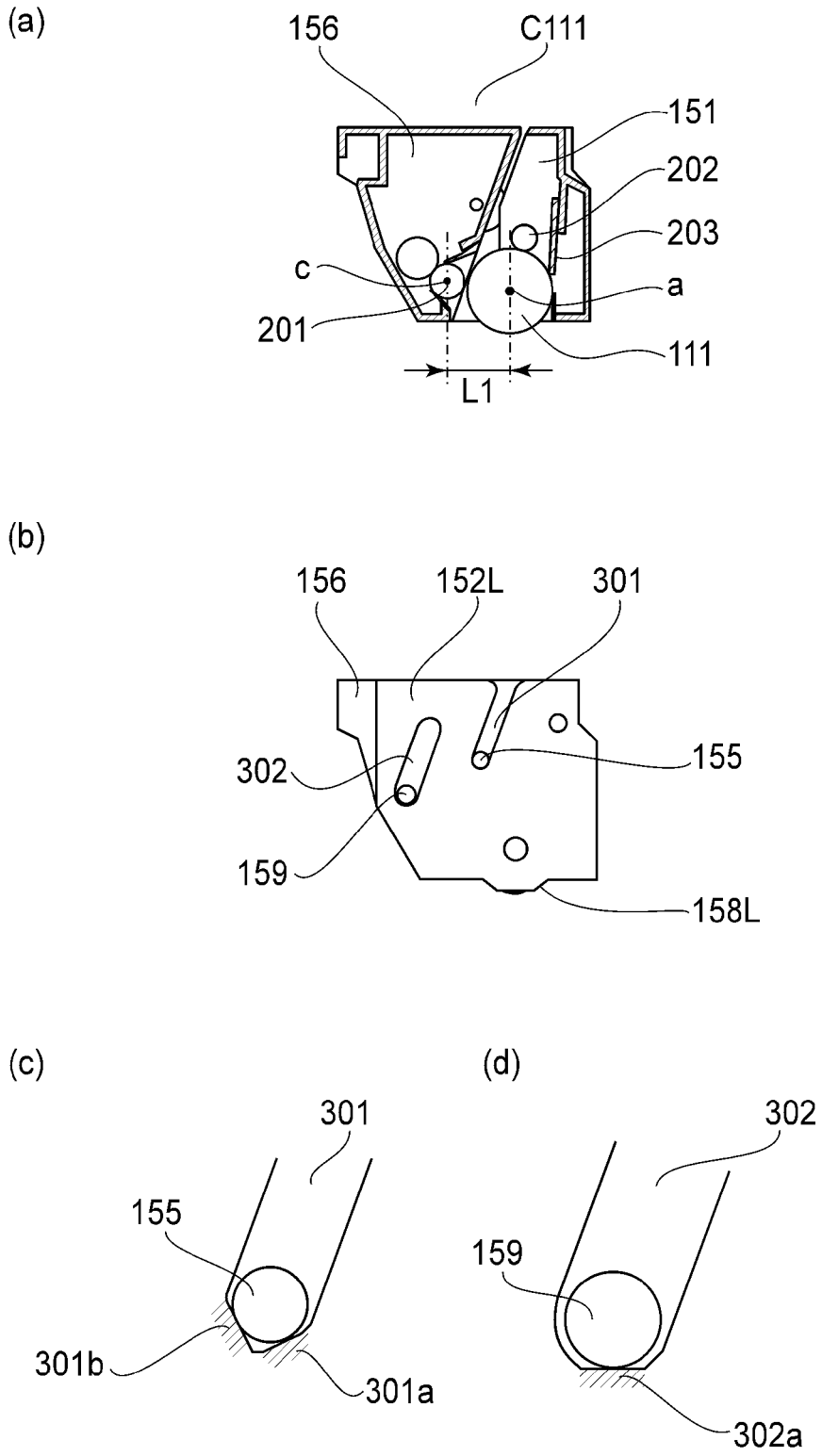
In FIG. 7, (a) to (d) are illustrations each showing a structure of the cartridge.

Next, with reference to FIGS. 7 and 8, the slide movement constitution, as a feature of this embodiment, of the process cartridge C will be described. In FIG. 7, (a) to (d) are sectional (side) views of the process cartridge C at the image forming position (or an interrelating plate) as seen from the non-driving side, and in FIG. 8, (a) and (b) are sectional views of the process cartridge at an outside position as seen from the non-driving side.

Each of the left and right side covers 152L and 152R is provided with the slide guiding portions 301 and 302. The slide guiding portion 301 shown in (b) of FIG. 7 has a guide shape such that the projection 155 is movable while engaging with the slide guiding portion 301, and forms the positioning portions 301*a* and 301*b* at a lowermost portion as shown in (c) of FIG. 7. Further, the slide guiding portion 302 shown in (b) of FIG. 7 has a guide shape such that the projection 159 is movable while roughly engaging with the slide guiding portion 301, and forms a positioning portion 302*a* at a lowermost portion as shown in (d) of FIG. 7.

When the process cartridge C is in the image forming position, the projection 155 is positioned at the lowermost portion of the slide guiding portion 301 ((c) of FIG. 7). Further, the developing roller 201 (211, 221, 231) in the developing unit 156 is precisely positioned relative to the photosensitive drum 111 (112, 113, 114) in the photosensitive member unit 151 by the positioning portions 301*a* and 301*b*. At the same time, the projection 159 is positioned at the lowermost portion of the slide guiding portion 302 ((d) of FIG. 7). Further, the projection 159 contacts the positioning portion 302*a*, and suppresses rotation action about the positioning reference axis b-b.

In (a) of FIG. 7, a charging roller 202 as the charging means and a cleaning member 203 as the cleaning means are provided. The photosensitive member unit 151 includes the photosensitive drum 111, the charging roller 202 and the cleaning member 203.

Figure 8:
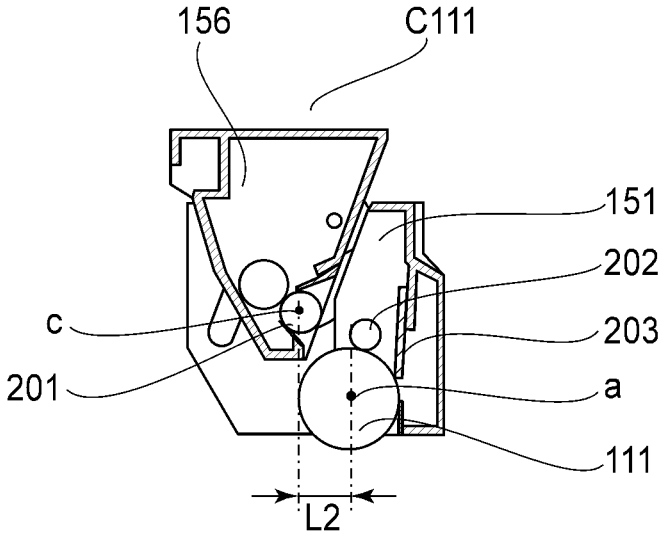
In FIG. 8, (a) and (b) are illustrations each showing a structure of the cartridge.
Figure 8:
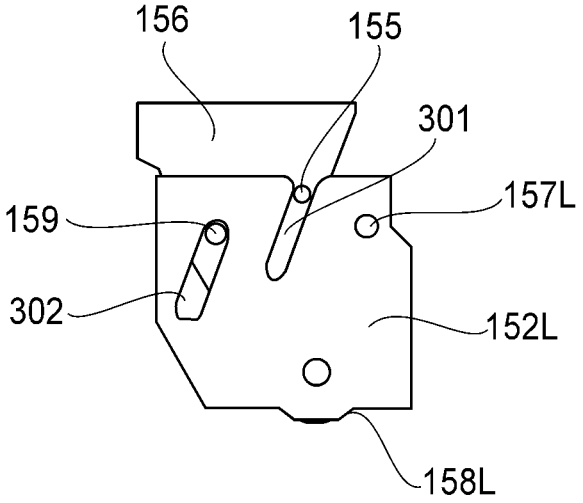

In FIG. 8, (a) is the side view showing a state in which the developing unit 156 slide-moved relative to the photosensitive member unit 151. As shown in (b) of FIG. 8, a whole of the developing unit 156 is moved upward, so that the projection 155 slides in the slide guiding portion 301 and thus moves to an uppermost portion. Further, similarly, also the projection 159 moves to an uppermost portion of the slide guiding portion 302. In this embodiment, although description is made by using the side view of the process cartridge C in the non-driving side, similar motion (movement) in the non-driving side is realized also in the driving side by employing a similar constitution.

(Slide Movement Constitution of Cartridge)

Figure 9:
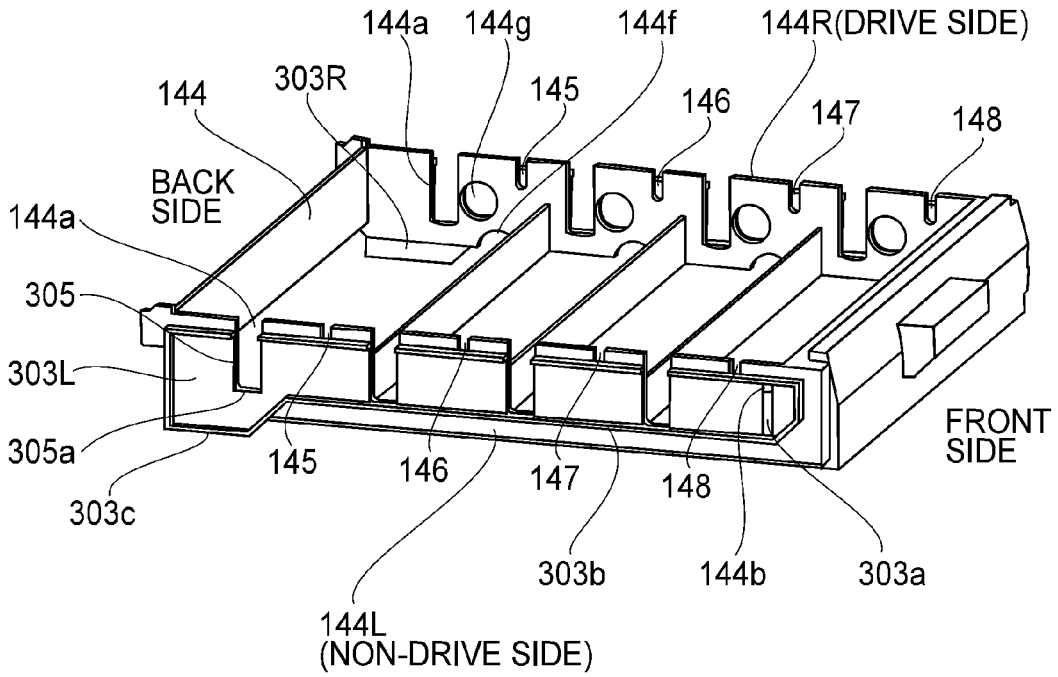
FIG. 9 is a perspective view of an outer appearance of the cartridge tray.
Figure 10:
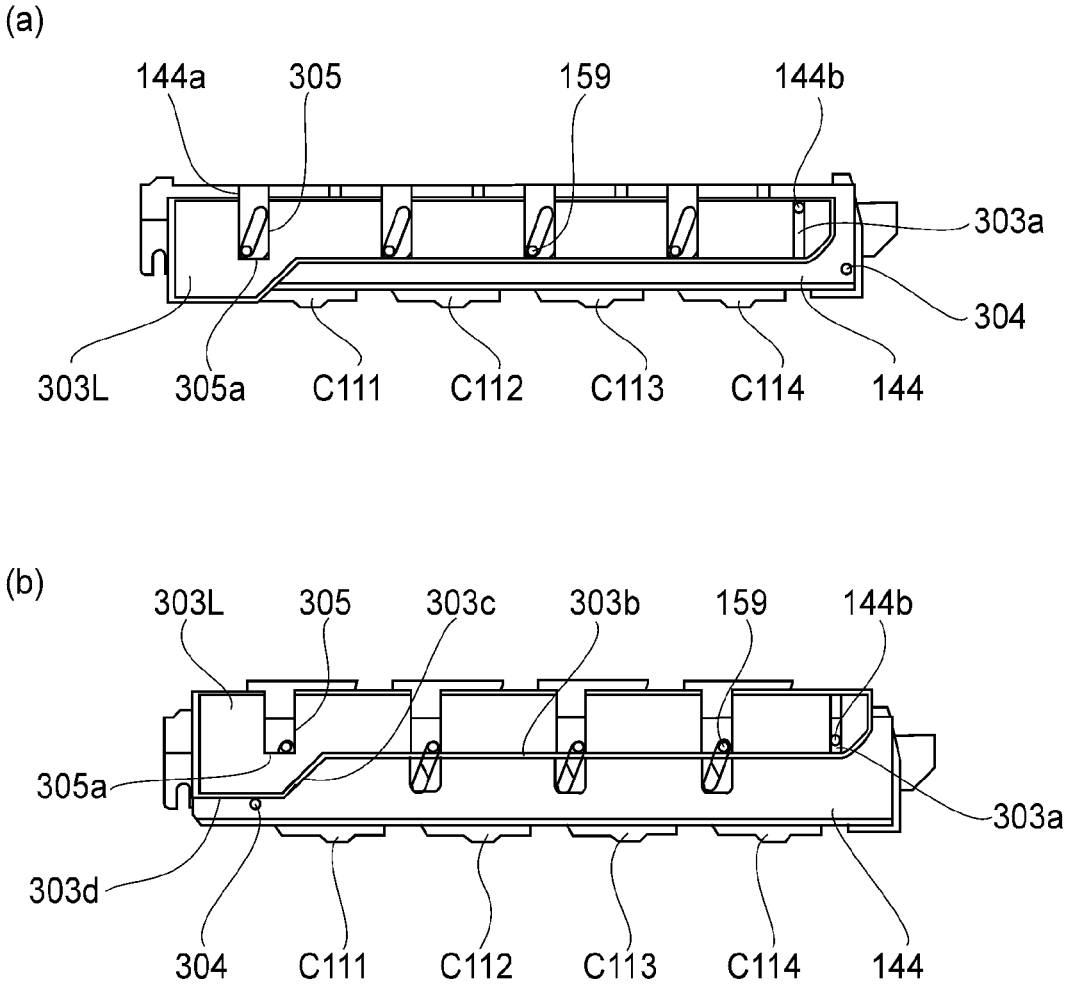
In FIG. 10, (a) and (b) are schematic side views each showing the cartridge tray.

With reference to FIGS. 9-11, the slide movement constitution as the feature of this embodiment will be described. FIG. 9 is a perspective view of an outer appearance of the cartridge tray 144. In FIG. 10, (a) and (b) are side views of outer appearances of the cartridge tray 144 before and after, respectively, the cartridge tray 144 is pulled out.

FIG. 11 is a schematic sectional view of the image forming apparatus at the outside position after the cartridge tray 144 is pulled out.

The cartridge tray 144 roughly supports the process cartridges C111, C112, C113 and C114. As shown in FIG. 9, the right frame portion 144R (driving side) is provided with holes 144*f* and 144*g* through which first and second drive output portions (not shown) provided in the apparatus main assembly 101 side go in and out of the cartridge tray 144. Further, the right frame portion 144R is provided with engaging portions 145, 146, 147 and 148 with which the driving side rotation preventing portions 157R are to be engaged. Further, a left frame 144L (non-driving side) is similarly provided with engaging portions 145, 146, 147 and 148 with which the non-driving side rotation preventing portions 157L are to be engaged.

Further, each of the left and right frame portions 144L and 144R is provided with a groove 144*a* engageable with the projection 159 projected through the slide guiding portion 302 provided in the associated one of the left and right side frames 152L and 152R of the process cartridge C. The grooves 144*a* are provided at four positions correspondingly to the process cartridges C for the respective colors.

Further, as an interrelating member, each of left and right interrelating plates 303L and 303R is provided with a sliding hole 303*a* engageable with a slidable boss 144*b* provided on a cartridge tray side surface, and holds an outside of the cartridge tray 144 so as to be slidably movable in an up-down direction.

In FIG. 10, (a) shows a state in which the process cartridges C are in the image forming position (or the interrelating plate). Each of the left and right interrelating plates 303L and 303R is provided with a groove 305 engageable with the projection 159 projected through the slide guiding portion 302 provided in the associated one of the left and right side frames 152L and 152R of the process cartridge C. At a lowermost portion of the groove 305, a lift surface 305*a* contactable to the projection 159 is formed. At the image forming position shown in (a) of FIG. 10, the projection 159 does not contact the lift surface 305*a* as yet.

Further, in interrelation with the opening operation of the cartridge door 140, also at the interrelating plate to which the left and right tray holding members 143 and the cartridge tray 144 are moved, the state of (a) of FIG. 10 is maintained. That is, a relative positional relationship among the process cartridges C111, C112, C113 and C114, the cartridge tray 144 and the left and right interrelating plates 303L and 303R is not changed.

Each of the left and right tray holding members 143 is provided with a lift member 304 in the inside of the apparatus main assembly. As shown in (a) of FIG. 10, the image forming position and the interrelating plate, the lift member 304 is in a positional relationship such that the lift member 304 does not contact the left interrelating plate 303L.

From this state, when an operation for pulling out the cartridge tray 144 from the apparatus main assembly 101 is performed, the lift member 304 contacts an inclined lift surface 303*c* while relatively passing through below a lower surface 303*b* of the left interrelating plate 303L. Thereafter, the lift member 304 continuously moves in the rear (back) direction of the apparatus main assembly while contacting the inclined lift surface 303*c*, and then contacts a lift (member) receiving surface 303*d* as a lower-side horizontal surface of the left interrelating plate 303L. Thereafter, the lift member 304 stops at the time when the lift member 304 somewhat moves.

That is, in the case where the pulling-out operation of the cartridge tray 144 from the apparatus main assembly 101 is performed, the left and right interrelating plates 303L and 303R start movement in the upward direction of the apparatus main assembly while being guided by the sliding hole 303*a* from the moment when the inclined lift surface 303*c* contacts the lift member 304. Then, the interrelating plates 303L and 303R stop the upward movement at the time when the lift member 304 reaches the longitudinal receiving surface 303*d*.

In this case, immediately after the start of the upward movement of the left and right interrelating plates 303L and 303R, the lift surface 305*a* of each of the left and right interrelating plates 303L and 303R contacts the projection 159. Then, with the upward movement of the left and right interrelating plates 303L and 303R, the developing unit 156 of each of the process cartridges for the respective colors starts slide movement relative to the photosensitive member unit 151 along the slide guiding portion 302.

In this way, as shown in FIGS. 4 and 11, when the cartridge tray 144 is pulled out from the apparatus main assembly 101, the upper surface of each of the process cartridges is exposed (open), and at the same time, the developing unit 156 slide-moves relative to the photosensitive member unit 151 in interrelation with the pulling-out operation.

As a result, as shown in FIG. 11 at the portion B, adjacent process cartridges are in a state in which the process cartridges do not overlap with each other with respect to a dismounting direction, and therefore the process cartridges C111, C112, C113 and C114 are dismountable in arrow directions, so that usability is improved. Further, the developing unit 156 slide-moves and pops up, and therefore as shown in FIG. 12, a user can easily perform mounting and dismounting of the cartridge C relative to the tray 144 by gripping a handle 501 provided at an upper end portion of the developing unit 156.

Further, when the process cartridges C111-C114 are mounted inside the apparatus main assembly 101, the process cartridges are disposed so as to minimize a pitch (distance) between the photosensitive drums of adjacent cartridges while ensuring a space of parts necessary to the process cartridges and a volume of the developer. This can be realized by disposing the adjacent cartridges so that the photosensitive member unit 151 of one of the adjacent cartridges and the developing unit 156 of the other cartridge overlap with each other with respect to the up-down direction of the apparatus main assembly 101. Accordingly, it is possible to realize not only shortening of a FPOT but also downsizing of the apparatus main assembly 101.

Figure 12:
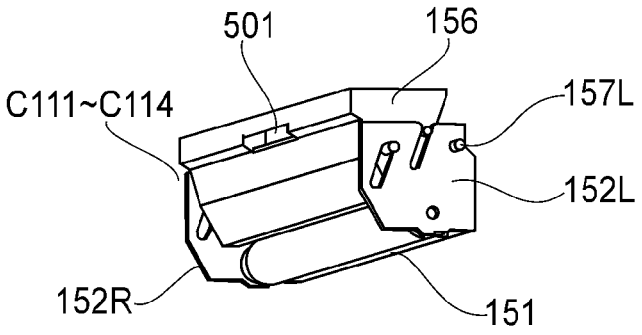
FIG. 12 is a perspective view of an outer appearance of the cartridge in a state in which a developing unit pops up.

In Embodiment 1, although the description is made based on an ITB (intermediary transfer belt) type using the intermediary transfer belt 130, also in an image forming apparatus of an ETB (electrostatic transfer belt) type using an electrostatic conveying belt as shown in FIG. 12, a similar effect can be obtained by employing a similar constitution.

The constitution of the above-described image forming apparatus 100 is summarized as follows.

(1) The plurality of the process cartridges C are detachably mountable to the image forming apparatus 100, and the image forming apparatus 100 is capable of forming a color image on the recording material 8.

Each of the process cartridges includes the photosensitive member unit 151 including the photosensitive drum 111 and the developing unit 156 including the developing roller 201. The developing unit 156 is movable relative to the photosensitive member unit 151.

The movable member 144 movable between the inside and the outside of the apparatus main assembly 101 of the image forming apparatus 100 with respect to the movement direction crossing the longitudinal direction of the photosensitive drum 111 in the state in which the movable member 144 supports the plurality of the process cartridges C, is provided.

The mounting portion, provided in the movable member, for supporting the plurality of the process cartridges and for permitting mounting and dismounting of the plurality of the process cartridges relative thereto from the direction crossing the longitudinal direction and the movement direction.

The interrelating member interrelations 303R and 303L movable in interrelation with the movement of the movable member are provided. The interrelating members move, when the movable member is moved from the inside to the driving side of the apparatus main assembly, the developing unit relative to the photosensitive member unit so that the distance between the rotation center of the photosensitive drum and the rotation center c of the developing roller with respect to the movement direction is decreased from L1 to L2 (FIGS. 8 and 9).

(2) When the movable member is moved from the inside to the outside of the apparatus main assembly, the interrelating members move the developing unit toward the downstream side of the dismounting direction (the arrow directions in FIG. 11) in which the process cartridges are dismounted from the mounting portion.

(3) When the movable member is positioned at the inside of the apparatus main assembly, the adjacent process cartridges are mounted at the mounting portion so that the developing unit of one of the adjacent process cartridges and the photosensitive member unit of the other process cartridge are in the overlapping state with respect to the dismounting direction in which the process cartridges are dismounted from the mounting portion.

(4) The interrelating members are provided movably relative to the movable member (FIGS. 9 and 10).

(5) Each of the interrelating members is provided with the engaging portion 305*a* engageable with the developing unit in order to move the developing unit.

(6) When the movable member is moved from the outside to the inside of the apparatus main assembly, the interrelating members permit the movement of the developing unit toward the upstream side with respect to the dismounting direction in which the process cartridges are dismounted from the mounting portion.

Further, the constitution of each of the process cartridges C is summarized as follows.

(1) The process cartridge C is detachably mountable to the mounting portion of the image forming apparatus 100.

The image forming apparatus is capable of forming the color image on the recording material. The movable member 144 movable between the inside and the outside of the apparatus main assembly 101 of the image forming apparatus 100 with respect to the movement direction crossing the longitudinal direction of the photosensitive drum 111 of the process cartridge C in the state in which the movable member 144 supports the plurality of the process cartridges C, is provided.

The mounting portion, provided in the movable member, for supporting the plurality of the process cartridges and for permitting mounting and dismounting of the plurality of the process cartridges relative thereto from the direction crossing the longitudinal direction and the movement direction.

The interrelating member interrelations 303R and 303L movable in interrelation with the movement of the movable member are provided.

Each of the process cartridges C includes the photosensitive member unit 151 including the photosensitive drum 111 and the developing unit 156 including the developing roller 201 actable on the photosensitive drum. The developing unit is moved, by the movement of the interrelating members when the movable member is moved from the inside to the outside of the apparatus main assembly, relative to the photosensitive member unit so that the distance between the rotation center of the photosensitive drum and the rotation center of the developing roller is decreased.

(2) The process cartridge includes the first side cover 152L provided in one side of the photosensitive member unit with respect to the longitudinal direction of the photosensitive drum and the second side cover 152R provided in the other side. The developing unit is moved relative to the photosensitive member unit by being guided along the guiding portions 301 and 302 provided in the first and second side covers.

(3) The developing unit is moved relative to the photosensitive member unit so that the distance between the rotation center of the photosensitive drum and the rotation center of the developing roller with respect to the movement direction is decreased. As a result, the cross-sectional area, of the process cartridge, perpendicular to the dismounting direction in which the process cartridge is dismounted from the mounting portion is decreased compared with that before the movement.

(4) The developing unit includes the portion-to-be-engaged 159 engageable with the interrelating members so as to be moved by the interrelating members.

(5) The developing unit includes the grip portion (handle) 501, for permitting the user to grip the process cartridge, in the downstream side with respect to the dismounting direction in which the process cartridge is dismounted from the mounting portion.

Embodiment 2

Embodiment 2 of the present invention will be described with reference to FIGS. 13-20. In this embodiment, constituent elements similar to the above-described constituent elements in Embodiment 1 will be omitted from description by adding the same reference numerals or symbols. In this embodiment, first to fourth process cartridges C211, C212, C213 and C214, and a cartridge tray 244 are used.

(Structure of Process Cartridge)

In this embodiment, the first to fourth process cartridges C211-C214 have the same contact developing method constitution.

That is, at the image forming position 100, the developing roller 201 in the developing unit 156 contacts the photosensitive drum 111 by using unshown flange member S. Further, other basic constitutions include the photosensitive member unit 151, the developing unit 156, the left side cover 152L and the right side cover 153R similarly as in Embodiment 1.

Figure 13:
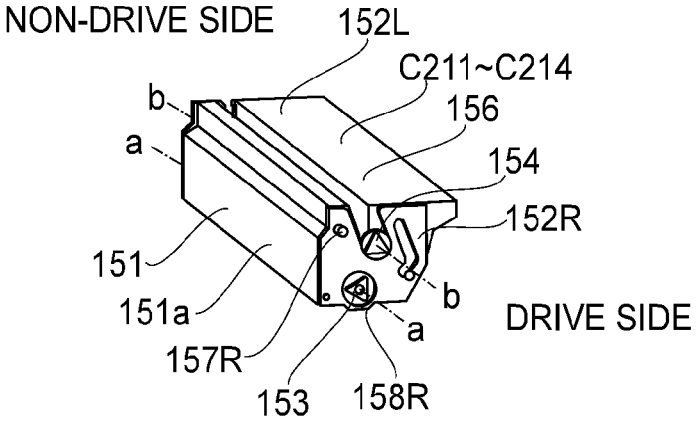
FIG. 13 is a perspective view of an outer appearance of a cartridge tray as seen from a driving side in Embodiment 2.
Figure 14:
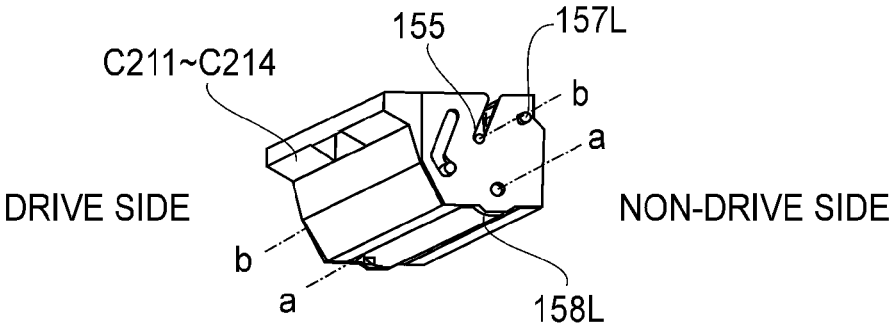
FIG. 14 is a perspective view of an outer appearance of the cartridge tray as seen from a non-driving side.

A general structure of each process cartridge C in this embodiment will be described with reference to FIGS. 13 and 14. FIGS. 13 and 14 are perspective views of the process cartridge C as seen from a driving side and a non-driving side, respectively.

The developing unit 156 is supported swingably about an axis b-b, as a rotation center, parallel to the drum axis a-a. The rotation center b-b of the developing unit 156 is aligned with a center of a developing roller driving coupling (second drive input portion, developing roller driving force receiving portion) 154 in the right side cover 152R side as the driving side. Further, in the left side cover 152L side as the non-driving side, the rotation center b-b is aligned with a center of a projection (projected portion) 155.

That is, a center axis of the coupling 154 and a center axis of the projection 155 are substantially aligned with each other with respect to cross-sectional coordinates. Further, a projection (projected portion) 159 is formed so as to project from an associated one of the left and right side surfaces, and is combined with a slide guiding portion 402 of each of the left and right side covers 152L and 152R so as to be engaged with the slide guiding portion 402.

Next, with reference to FIGS. 15-17, development contact-and-separation (spacing) constitution, as a feature of this embodiment, of the process cartridge C will be described. Parts (a) to (d) of FIG. 15, (a) and (b) of FIG. 16 and (a) and (b) of FIG. 17 are sectional (side) views of the process cartridge C at an image forming position (development contact position), an interrelating plate (development separation position) and an outside position, respectively, as seen from the non-driving side.

Each of the left and right side covers 152L and 152R is provided with the slide guiding portions 401 and 402. The slide guiding portion 401 shown in (b) of FIG. 15 has a guide shape such that the projection 155 is movable while engaging with the slide guiding portion 401, and forms the positioning portions 401*a* and 401*b* at a lowermost portion as shown in (c) of FIG. 15. Further, the slide guiding portion 402 shown in (b) of FIG. 15 has a substantially L-character guide shape such that the projection 159 is movable while roughly engaging with the slide guiding portion 301, and is constituted by two regions consisting of a contact-and-separation swing portion 402*a* and a slide movement portion 402*b*.

When the process cartridge C is in the image forming position and when the developing roller 201 in the developing unit 156 is in a contact state with the photosensitive drum 111 in the photosensitive member unit 151, the projection 155 is positioned at the lowermost portion of the slide guiding portion 401. Further, the developing unit 156 is precisely positioned relative to the photosensitive member unit 151 by the positioning portions 401*a* and 401*b*. At the same time, the projection 159 is positioned at the lowermost portion of the slide guiding portion 402.

However, the position of the developing unit 156 is determined by the contact of the developing roller 201 with the photosensitive drum 111 by using the unshown flange members, and therefore the projection 159 does not contact an inner peripheral surface of the slide guiding portion 402.

Figure 16:
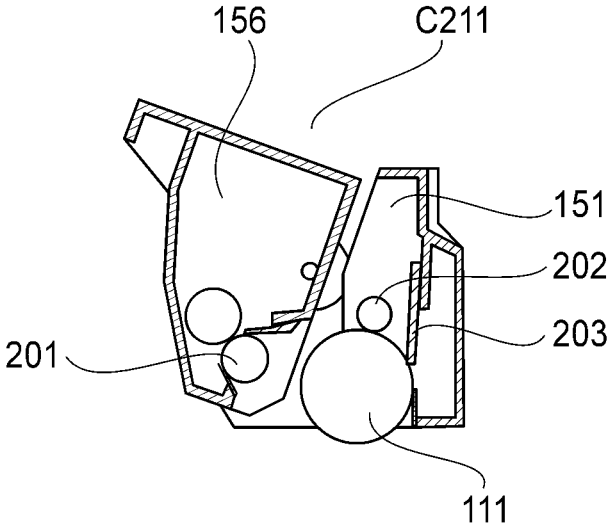
In FIG. 16, (a) and (b) are illustrations each showing a structure of the cartridge.
Figure 16:
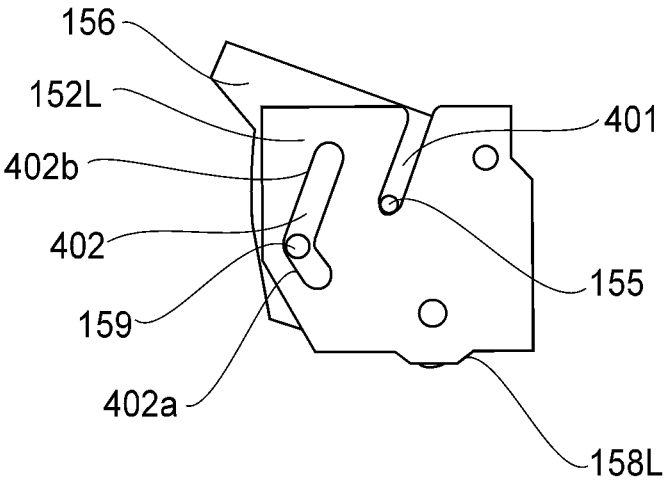
Figure 17:
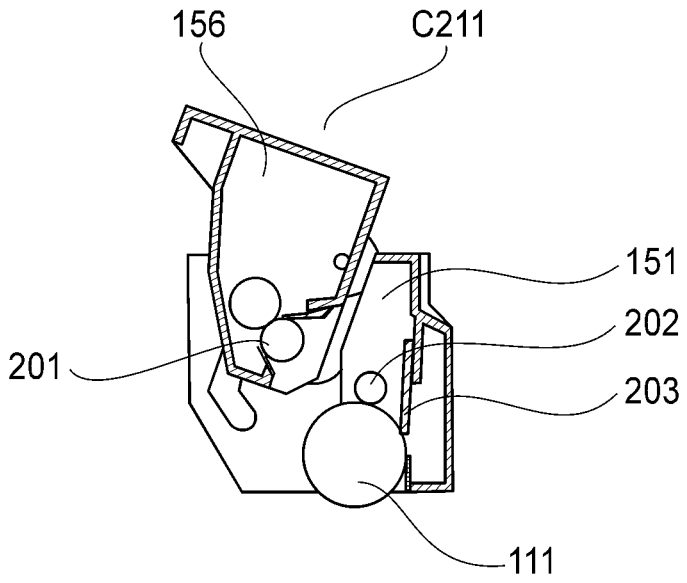
In FIG. 17, (a) and (b) are illustrations each showing a structure of the cartridge.
Figure 17:
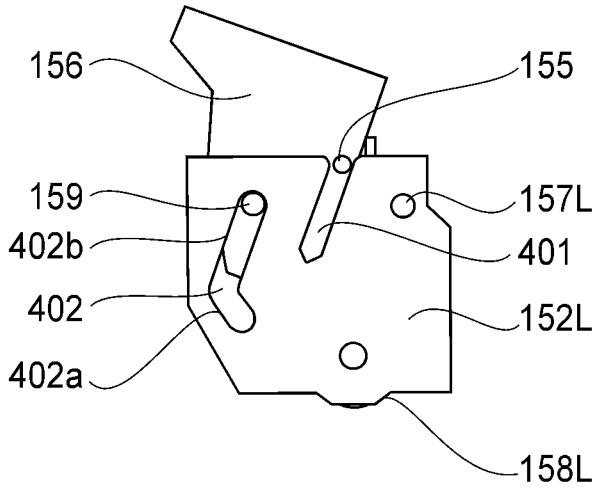

In FIG. 16, (a) is a sectional view showing a state in which the developing roller 201 in the developing unit 156 is separated (spaced) from the photosensitive drum 111 in the photosensitive member unit 151 by a main assembly-side development contact-and-separation mechanism described later. As shown in (b) of FIG. 16, the developing unit 156 swings about the projection 155 relative to the photosensitive drum 111, and therefore, the position of the projection 155 is not changed from that in the contact state and is still at the lowermost portion of the slide guiding portion 401.

On the other hand, the projection 159 rotates about the projection 155 as a swing rotation center of the developing unit 156 and moves along the contact-and-separation swing portion 402*a* of the slide guiding portion 402 to reach an intermediary position of the substantially L-character guides shape.

In FIG. 17, (a) is the side view showing a state in which the developing unit 156 slide-moved relative to the photosensitive member unit 151. As shown in (b) of FIG. 17, a whole of the developing unit 156 is moved upward, so that the projection 155 slides in the slide guiding portion 401 and thus moves to an uppermost portion. Further, similarly, also the projection 159 moves to an uppermost portion of the slide guiding portion 402.

Figure 15:
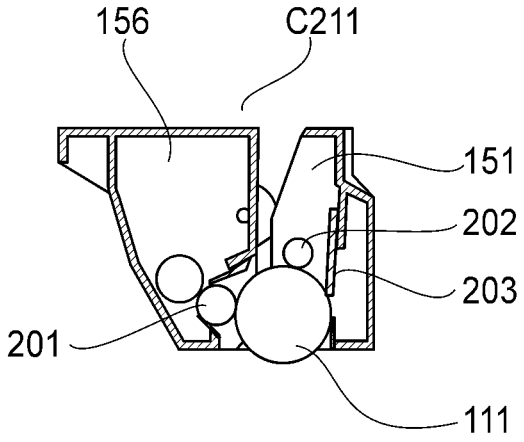
In FIG. 15, (a), (b) and (c) are illustrations each showing a structure of the cartridge.
Figure 15:
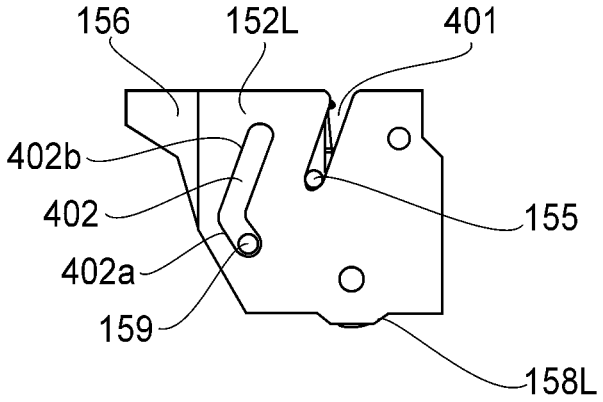
Figure 15:
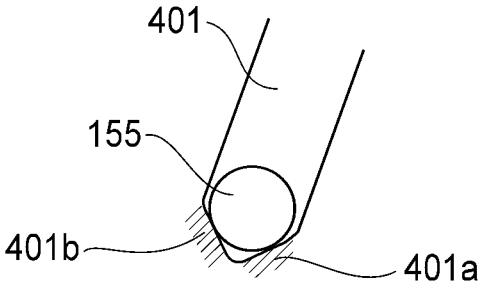

Further, as is understood from also FIGS. 15-17, in order to start the slide movement of the developing unit 156, the developing roller 201 is required to be once placed in a separated (spaced) state in which the developing roller 201 is separated from the photosensitive drum 111. That is, the slide guiding portion 402 has the substantially L-character (guide) shape, so that the slide guiding portion also performs the action of preventing direct slide movement of the developing roller 201 from the contact state with the photosensitive drum 111.

As a result, it is possible to prevent the slide movement between the developing roller 201 and the photosensitive drum 111 while these members slide with each other, and therefore surface abrasion (wearing) of the developing roller 201 and the photosensitive drum 111 can be suppressed to a minimum level.

In this embodiment, although description is made by using the side view of the process cartridge C in the non-driving side, similar motion (movement) in the non-driving side is realized also in the driving side by employing a similar constitution.

(Development Contact-and-Separation Constitution of Cartridge)

Figure 18:
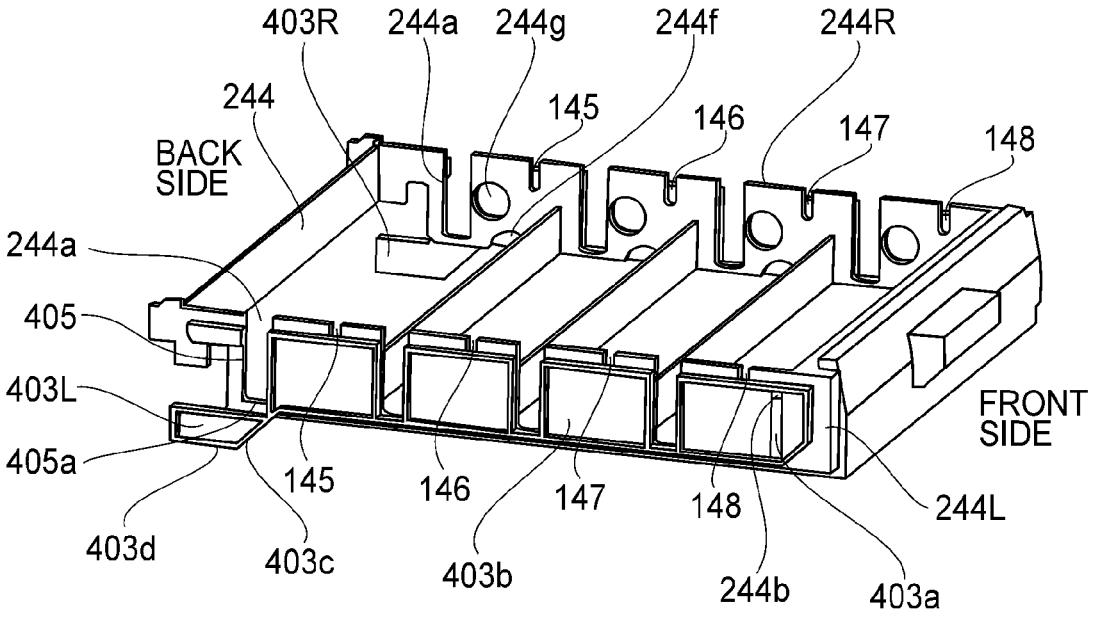
FIG. 18 is a perspective view of an outer appearance of the cartridge tray.
Figure 19:
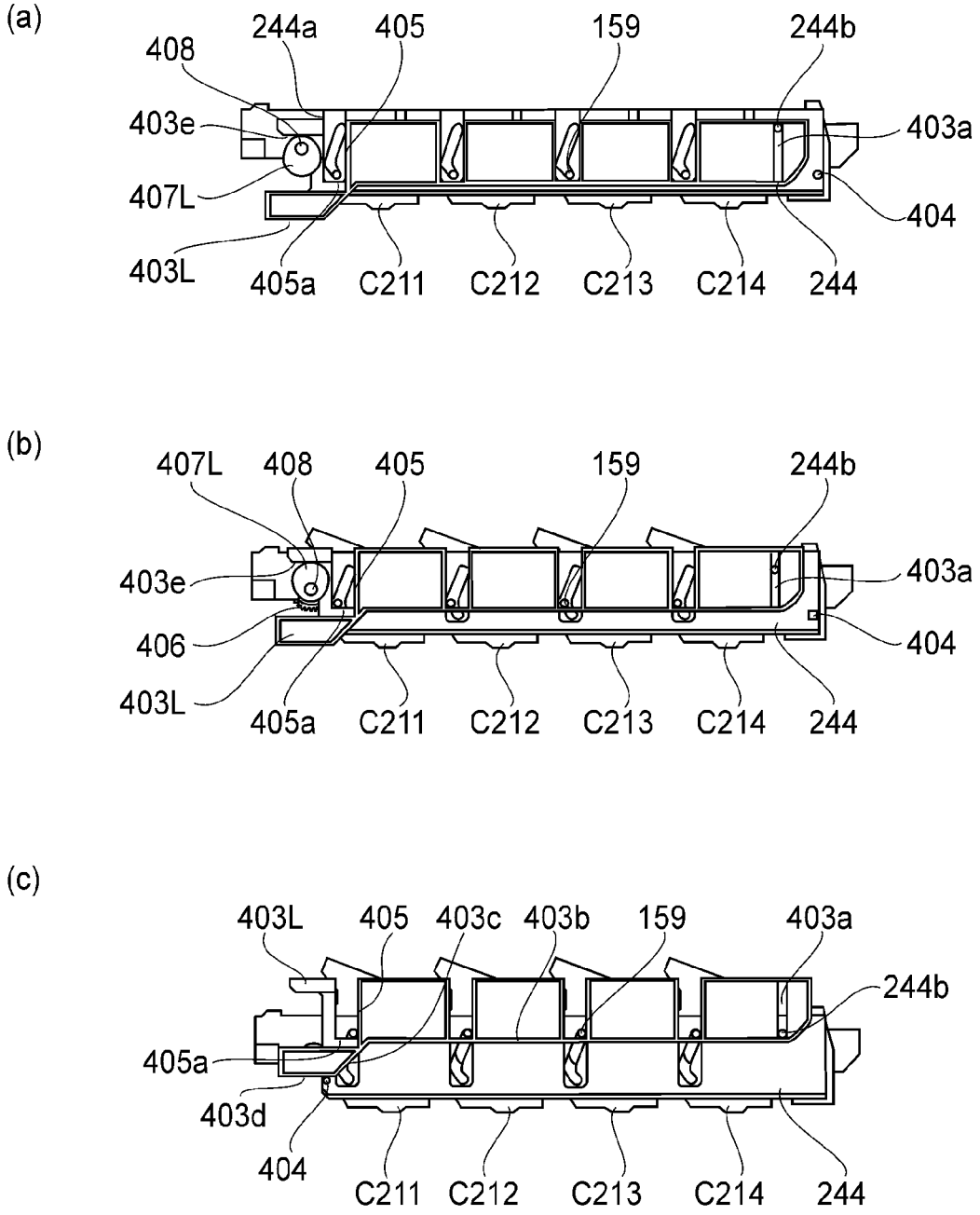
In FIG. 19, (a), (b) and (c) are schematic side views each showing the cartridge tray.

With reference to FIGS. 18 and 19, the development contact-and-separation constitution as the feature of this embodiment will be described. FIG. 18 is a perspective view of an outer appearance of the cartridge tray 244. In FIG. 19, (a) and (b) are side views of outer appearances of the cartridge tray 244 before and after, respectively, the development contact-and-separation.

Similarly as Embodiment 1, each of left and right interrelating plates 403L and 403R is provided with a sliding hole 403*a* engageable with a slidable boss 244*b* provided on a cartridge tray side surface, and holds an outside of the cartridge tray 144 so as to be slidably movable in an up-down direction.

In FIG. 19, (a) shows a state in which the process cartridges C are in the image forming position (or the interrelating plate). Each of the left and right interrelating plates 403L and 403R is provided with a groove 405 engageable with the projection 159 projected through the slide guiding portion 402 provided in the associated one of the left and right side frames 152L and 152R of the process cartridge C. At a lowermost portion of the groove 405, a lift surface 405*a* contactable to the projection 159 is formed. At the image forming position shown in (a) of FIG. 19, the projection 159 does not contact the lift surface 405*a* as yet.

In a rear side of the cartridge tray 244 in the apparatus main assembly 101, a development contact-and-separation shaft 408 extending between the main assembly side plates is rotatably disposed. In the neighborhood of the side plates, on the development contact-and-separation shaft 408, development contact-and-separation cams 407L and 407R are mounted, respectively. Further, in the driving side of the apparatus main assembly, a development contact-and-separation gear 406 is provided in combination with the associated development contact-and-separation cam. The development contact-and-separation gear 406 rotates the development contact-and-separation shaft 408 at predetermined timing by transmitting thereto (rotational) driving force from an unshown driving source.

Further, the left and right interrelating plates 403L and 403R have receiving surfaces 403*e* contactable with cam surfaces of the above-described left and right development contact-and-separation cams 407L and 407R, respectively.

The rotational driving force transmitted from the unshown driving source is transmitted to the development contact-and-separation gear 406, the development contact-and-separation shaft 408 and the development contact-and-separation cams 407L and 407R, and then moves upward and downward the left and right interrelating plates 403L and 403R at the same phase via the receiving surfaces 403*e*. The left and right interrelating plates 403L and 403R start movement thereof in the upward direction of the main assembly while being guided by the sliding hole 403*a*, and immediately after the start of the upward movement, the lift surfaces 405*a* of the left and right interrelating plates 403L and 403R contact the projections 159.

With the rotation of the development contact-and-separation cams 407L and 407R, the interrelating plates 403L and 403R continuously move upward, and then stop, as shown in (b) of FIG. 19, at the time when the phase of the development contact-and-separation cams 407L and 407R rotates by 180 degrees. At the same time, the interrelating plates 403L and 403R stop the upward movement thereof at an uppermost position of lifting-up by the development contact-and-separation cams 407L and 407R.

At this time, the projections 159 are pushed up by the lift surfaces 405*a* of the left and right interrelating plates 403L and 403R. At the same time, the projections 159 are moved to the intermediary position of the substantially L-character shape by being guided along the contact-and-separation swing portions 402*a* of the slide guiding portions provided in the left and right side covers 152L and 152R. With this operation, the developing unit 156 rotates and swings about the projections 155, so that a separating (spacing) operation from the photosensitive drum 111 is ended.

Also when the developing unit 156 is returned from the separated state shown in (b) of FIG. 19 to the contact state shown in (a) of FIG. 19, the operation can be described by similar motion. The interrelating plates 403L and 403R are moved downward in interrelation with the rotating operation such that the development contact-and-separation cams 407L and 407R further rotates from the state shown in (b) of FIG. 19 by 180 degrees and stop. As a result, the projections 159 rotate and swing about the projections 155, so that the developing unit 156 contacts again the photosensitive drum 111 by using the unshown flange members.

Further, in a printing step of the image forming apparatus 100, when the above-described development contact-and-separation operation is always performed in a final step of a printing job, it is possible to pull out the cartridge tray 244 as it is to the outside of the apparatus main assembly 101. That is, when the cartridge door 140 is opened at the time when the image forming apparatus 100 is in a stand-by state in which the image forming apparatus 100 does not perform the printing operation, the cartridge tray 244 can be moved to the interrelating plate while being kept in the separated state shown in (b) of FIG. 19, so that the cartridge tray 244 can be pulled out to the outside of the apparatus main assembly as it is.

(Slide Movement Constitution of Cartridge)

With reference to FIG. 19, the slide movement constitution, of the process cartridge, as a feature of this embodiment will be described. In FIG. 19, (c) is a schematic sectional view of the cartridge tray 244, after being pulled out, at the outside position of the image forming apparatus.

As shown in FIG. 19, each of the left and right tray holding members 143 is provided with a lift member 404 in the inside of the apparatus main assembly. As shown in (a) and (b) of FIG. 19, the image forming position (development contact position) and the interrelating plate (development separation position), the lift member 404 is in a positional relationship such that the lift member 404 does not contact the left interrelating plate 403L.

From this state, when an operation for pulling out the cartridge tray 244 from the apparatus main assembly 101 is performed, the lift member 404 contacts an inclined lift surface 403*c* while relatively passing through below a lower surface 403*b* of the left interrelating plate 403L. Thereafter, the lift member 404 continuously moves in the rear (back) direction of the main assembly while contacting the inclined lift surface 403*c*, and then contacts a lift (member) receiving surface 403*d* as a lower-side horizontal surface of the left interrelating plate 403L. Thereafter, the lift member 404 stops at the time when the lift member 404 somewhat moves.

That is, in the case where the pulling-out operation of the cartridge tray 244 from the apparatus main assembly 101 is performed, the left and right interrelating plates 403L and 403R start movement in the upward direction of the apparatus main assembly while being guided by the sliding hole 403*a* from the moment when the inclined lift surface 403*c* contacts the lift member 404. Then, the interrelating plates 403L and 403R stop the upward movement at the time when the lift member 404 reaches the longitudinal receiving surface 403*d*.

In this case, the projections 159 are pushed up by the lift surface 405*a* of the left and right interrelating plates 403L and 403R. At the same time, the projections 159 are moved to the outside position shown in (c) of FIG. 19 by being guided by the slide movement portions 402*b* of the slide guiding portions 402 provided in the left and right side covers 152L and 152R.

Figure 20:
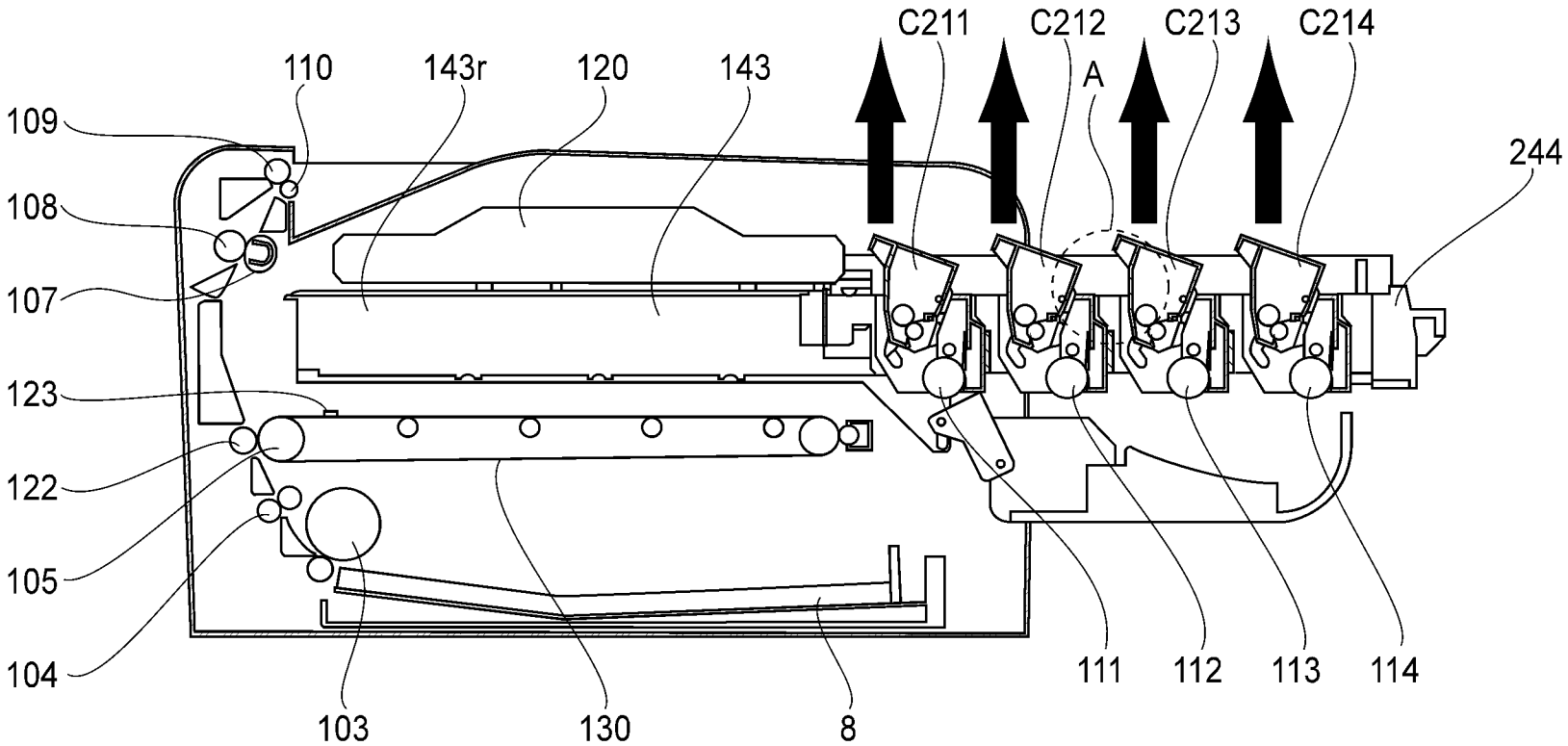
FIG. 20 is a longitudinal schematic side view of an image forming apparatus in a state in which the cartridge tray is pulled out.

In this way, as shown in FIGS. 4 and 20, when the cartridge tray 244 is pulled out from the apparatus main assembly 101, the upper surface of each of the process cartridges is exposed (open), and at the same time, the developing unit 156 slide-moves relative to the photosensitive member unit 151 in interrelation with the pulling-out operation.

As a result, as shown in FIG. 20 at the portion A, adjacent process cartridges can be placed in a state in which the process cartridges do not overlap with each other with respect to a dismounting direction, and therefore the process cartridges C211, C212, C213 and C214 are dismountable in arrow directions, so that usability is improved. Further, the developing unit 156 slide-moves and pops up, and therefore as shown in FIG. 12 in Embodiment 1, a user can easily perform mounting and dismounting of the cartridge relative to the tray 244 by gripping a handle 501 provided at an upper end portion of the developing unit 156.

Further, when the process cartridges C211-C214 are mounted inside the apparatus main assembly 101, the process cartridges are disposed so as to minimize a pitch (distance) between adjacent photosensitive drums while ensuring a space of parts necessary to the process cartridges and a volume of the developer. This can be realized by disposing the adjacent cartridges so that the photosensitive member unit 151 of one of the adjacent cartridges and the developing unit 156 of the other cartridge overlap with each other with respect to the up-down direction of the apparatus main assembly 101. Accordingly, it is possible to realize not only shortening of a FPOT but also downsizing of the apparatus main assembly 101.

In Embodiment 2, although the description is made based on an ITB (intermediary transfer belt) type using the intermediary transfer belt 130, also in an image forming apparatus of an ETB (electrostatic transfer belt) type using an electrostatic conveying belt as shown in FIG. 12, a similar effect can be obtained by employing a similar constitution.

Embodiment 3

Embodiment 3 of the present invention will be described with reference to FIGS. 21 and 22. In this embodiment, constituent elements similar to the above-described constituent elements in Embodiments 1 and 2 will be omitted from description by adding the same reference numerals or symbols. In this embodiment, a cartridge tray 344 is used.

(Development Contact-and-Separation Constitution and Slide Movement Constitution of Cartridge)

Figure 21:
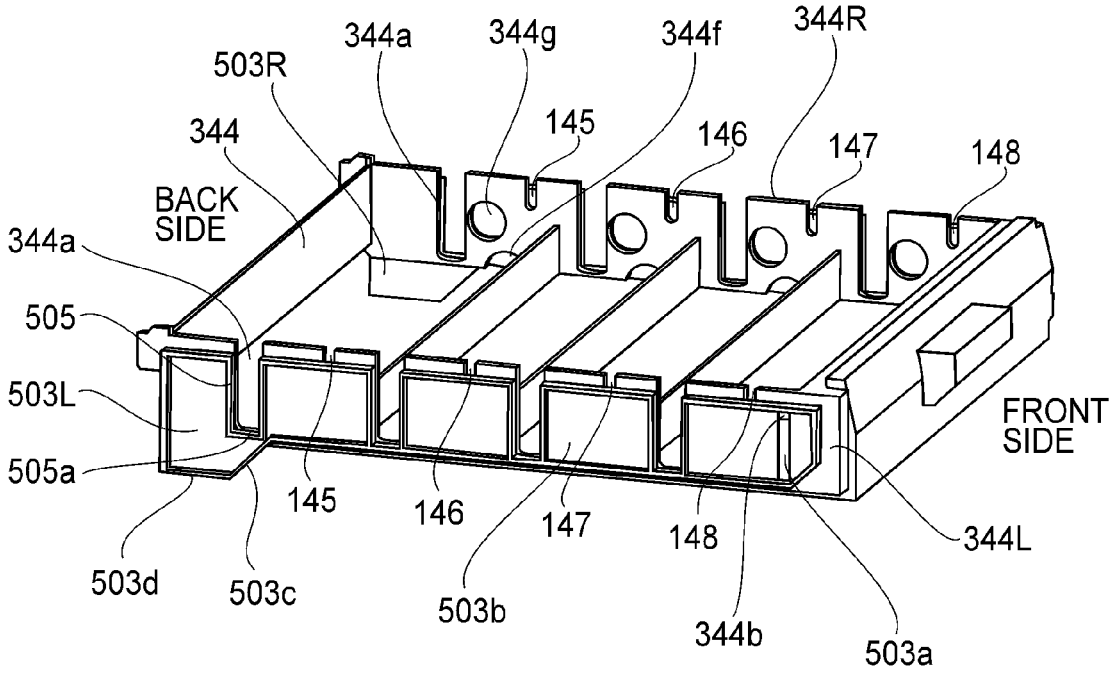
FIG. 21 is a perspective view of an outer appearance of a cartridge tray in Embodiment 3.
Figure 22:
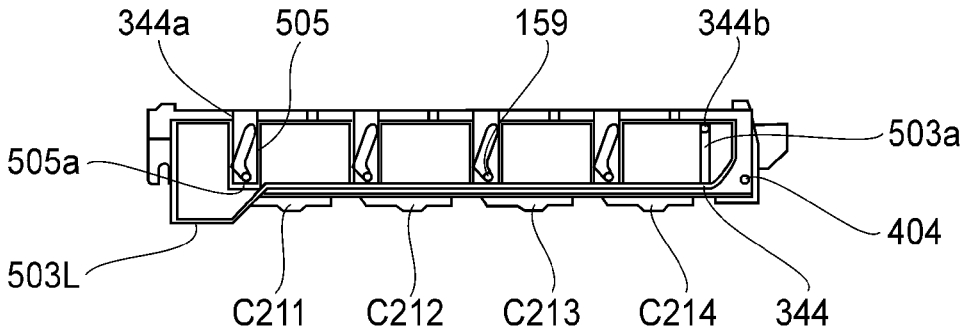
In FIG. 22, (a), (b) and (c) are schematic side views each showing the cartridge tray.
Figure 22:
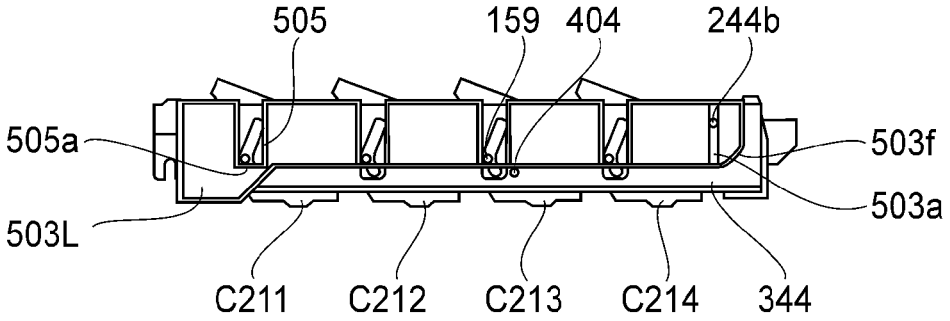
Figure 22:
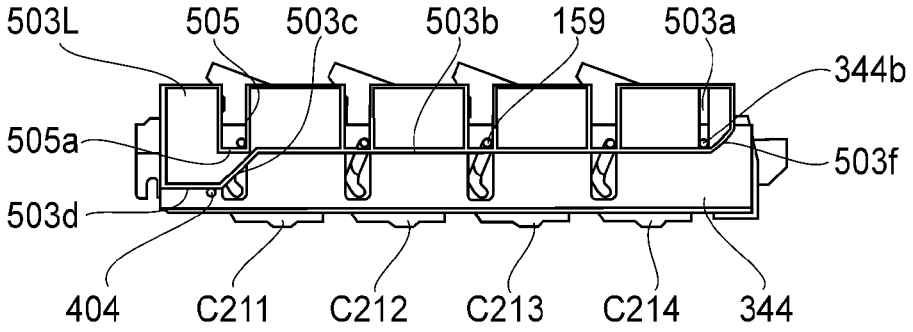

With reference to FIGS. 21 and 22, the development contact-and-separation constitution and slide movement constitution as features of this embodiment will be described. FIG. 21 is a perspective view of an outer appearance of the cartridge tray 344. In FIG. 22, (a) to (c) are side views of outer appearances of the cartridge tray 344 with the pulling-out operation.

As shown in FIG. 22, each of the left and right tray holding members 143 is provided with a lift member 404 in the inside of the apparatus main assembly. As shown in (a) of FIG. 22, at the image forming position (development contact position), the lift member 404 is in a non-contact positional relation with an interrelating plate 503L. Further, at this time, the projection 159 is precisely positioned by the positioning portions 401*a* and 401*b* of the slide guiding portion 401 of the process cartridge C, and does not contact a lift surface 505*a* provided on the interrelating plate 503L.

Also at the interrelating plate where the left and right tray holding members 143 and the cartridge tray 344 were moved in interrelation with the opening operation of the cartridge door 140, the state of (a) of FIG. 22 is maintained. That is, a relative positional relationship among the process cartridges C211, C212, C213 and C214, the cartridge tray 344, and the left and right interrelating plates 503L and 503R is invariant.

From this state, when the pulling-out operation of the cartridge tray 344 from the apparatus main assembly 101 is performed, the lift member 404 is moved relative to the apparatus main assembly toward the rear direction of the main assembly, and contacts an entry surface 503*f* of the left interrelating plate 503L. Thereafter, the lift member 404 continuously moves in the rear direction of the main assembly while contacting the entry surface 503*f*, and also after reaches a lower surface 503*b* of the left interrelating plate 503L, the lift member 404 further continuously moves in the rear direction of the main assembly while contacting the lower surface 503*b*.

At this time, as shown in (b) of FIG. 22, the left and right interrelating plates 503L and 503R start movement in the upward direction of the main assembly while being guided by the sliding holes 503*a* from the moment when the entry surfaces 503*f* contact the lift members 404. Then, the left and right interrelating plate 503L and 503R once stop the upward movement at the time when the lift members 404 reach the lower surfaces 503*b*.

Immediately after the start of the upward movement of the left and right interrelating plates 503L and 503R, the lift surfaces 505*a* of the left and right interrelating plates 503L and 503R contact the projections 159.

The projections 159 are pushed up by the lift surfaces 505*a* of the left and right interrelating plates 503L and 503R. At the same time, the projections 159 are moved to the intermediary position of the substantially L-character shape by being guided along the contact-and-separation swing portions 402*a* of the slide guiding portions provided in the left and right side covers 152L and 152R. With this operation, the developing unit 156 rotates and swings about the projections 155, so that a separating (spacing) operation from the photosensitive drum 111 is ended.

From this state, when the operation for further pulling out the cartridge tray 344 from the apparatus main assembly 101 is continued, the lift member 404 continuously moves in the rear direction of the apparatus main assembly while contacting the lower surface 503*b* as it is, thus contacting an inclined lift surface 503*c*. Thereafter, the lift member 404 continuously moves in the rear (back) direction of the main assembly while contacting the inclined lift surface 503*c*, and then contacts a lift (member) receiving surface 503*d* as a lower-side horizontal surface of the left interrelating plate 503L. Thereafter, the lift member 404 stops at the time when the lift member 404 somewhat moves.

That is, the left and right interrelating plates 503L and 503R start the movement in the upward direction of the apparatus main assembly again while being guided by the sliding hole 503*a* from the moment when the inclined lift surface 503*c* contacts the lift member 404. Then, the interrelating plates 503L and 503R stop the upward movement at the time when the lift member 404 reaches the longitudinal receiving surface 503*d*.

In this case, the projections 159 are pushed up again by the lift surface 505*a* of the left and right interrelating plates 503L and 503R. At the same time, the projections 159 are moved to the outside position shown in (c) of FIG. 22 by being guided by the slide movement portions 402*b* of the slide guiding portions 402 provided in the left and right side covers 152L and 152R.

In this way, when the cartridge tray 344 is pulled out from the apparatus main assembly 101, in a midstream of the pulling-out operation, the developing unit 156 rotates and swings about the projections 155, so that the developing unit 156 is spaced from the photosensitive drum 111. Then, immediately before the cartridge tray 344 is pulled out from the apparatus main assembly 101 toward the outside, the upper surface of each of the process cartridges is exposed (open), and at the same time, the developing unit 156 slide-moves relative to the photosensitive member unit 151 in interrelation with the pulling-out operation.

As a result, adjacent process cartridges can be placed in a state in which the process cartridges do not overlap with each other with respect to a dismounting direction, and therefore the process cartridges C211, C212, C213 and C214 are dismountable in arrow directions, so that usability is improved. Further, the developing unit 156 slide-moves and pops up, and therefore as shown in FIG. 12 in Embodiment 1, the user can easily perform mounting and dismounting of the cartridge by gripping a handle 501 provided at an upper end portion of the developing unit 156.

In this way, a constitution in which in the midstream of the pulling-out operation of the cartridge tray 344, the developing unit 156 can be spaced from the photosensitive drum 111 in interrelation with the pulling-out operation is employed. When this constitution is employed, even in a structure such that a particular development contact-and-separation mechanism is not provided in the apparatus main assembly 101, it is possible to prevent slide movement between the developing roller 201 and the photosensitive drum 111 while these members slide with each other.

Further, in the case of Embodiment 2, even when the user falls into a state in which the user intends to pull out the cartridge tray 344 from the apparatus main assembly 101 while the development contact-and-separation is not actuated by an unexpected cause, the user can meet the state. That is, in a similar manner, it is possible to prevent the slide movement between the developing roller 201 and the photosensitive drum 111 while these members slide with each other, and therefore it is possible to suppress surface abrasion of the developing roller 201 and the photosensitive drum 111 to a minimum level.

Further, when the process cartridges C211-C214 are mounted inside the apparatus main assembly 101, the process cartridges are disposed so as to minimize a pitch (distance) between adjacent photosensitive drums while ensuring a space of parts necessary to the process cartridges and a volume of the developer. This can be realized by disposing the adjacent cartridges so that the photosensitive member unit 151 of one of the adjacent cartridges and the developing unit 156 of the other cartridge overlap with each other with respect to the up-down direction of the image forming apparatus main assembly. Accordingly, it is possible to realize not only shortening of a FPOT but also downsizing of the image forming apparatus main assembly.

In Embodiment 2, although the description is made based on an ITB (intermediary transfer belt) type using the intermediary transfer belt 130, also in an image forming apparatus of an ETB (electrostatic transfer belt) type using an electrostatic conveying belt as shown in FIG. 12, a similar effect can be obtained by employing a similar constitution.

In Embodiment 3, although the description is made based on an ITB (intermediary transfer belt) type using the intermediary transfer belt 130, also in an image forming apparatus of an ETB (electrostatic transfer belt) type using an electrostatic conveying belt as shown in FIG. 12, a similar effect can be obtained by employing a similar constitution.

It is also possible to employ a constitution in which constituent elements of the image forming apparatus of Embodiments 1 to 3 are appropriately and selectively combined to provide an image forming apparatus.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 170304/2013 filed Aug. 20, 2013, which is hereby incorporated by reference.

What is claimed is:

1. An image forming apparatus, capable of forming a color image on a recording material, having a plurality of a process cartridges, each of which includes a photosensitive member unit including a photosensitive drum and each of which includes a developing unit which includes a developing roller actable on the photosensitive drum and which is movable relative to the photosensitive member unit, said image forming apparatus comprising:

a movable member movable between an inside and an outside of a main assembly of said image forming apparatus in a movement direction crossing a longitudinal direction of the photosensitive drum in a state in which the plurality of process cartridges are supported;

a mounting portion, provided in said movable member, for supporting the plurality of process cartridges, wherein the plurality of process cartridges are detachably mountable to said mounting portion from a direction crossing the longitudinal direction and the movement direction; and an interrelating member, movable in interrelation with movement of said movable member, for moving the developing unit relative to the photosensitive member unit so that a distance between a rotation center of the photosensitive drum and a rotation center of the developing roller is decreased with respect to the movement direction when said movable member is moved from the inside to the outside of the main assembly.

2. An image forming apparatus according to claim 1, wherein when said movable member is moved from the inside to the outside of the main assembly, said interrelating member moves the developing unit to a downstream side with respect to a dismounting direction in which the process cartridges are dismounted from said mounting portion.

3. An image forming apparatus according to claim 1, wherein the photosensitive member unit of the process cartridge adjacent to the developing unit of the adjacent process cartridge is mounted at said mounting portion so as to be in an overlapping state, with respect to a dismounting direction in which the process cartridges are dismounted from said mounting portion, when said movable member is positioned at the inside of the main assembly.

4. An image forming apparatus according to claim 1, wherein said interrelating member is provided movably relative to said movable member.

5. An image forming apparatus according to claim 1, wherein said interrelating member includes an engaging portion engageable with the developing unit in order to move the developing unit.

6. An image forming apparatus according to claim 1, wherein when said movable member is moved from the outside to the inside of the main assembly, said interrelating member permits movement of the developing unit from said mounting portion to an upstream side with respect to a dismounting direction in which the process cartridges are dismounted from said mounting portion.

7. A process cartridge detachably mountable to an image forming apparatus, capable of forming a color image on a recording material, including a movable member between an inside and an outside of a main assembly of said image forming apparatus in a movement direction crossing a longitudinal direction of a photosensitive drum of said process cartridge in a state in which a plurality of said process cartridges are supported; a mounting portion, provided in the movable member, for supporting the plurality of said process cartridges, wherein the plurality of said process cartridges are detachably mountable to the mounting portion from a direction crossing the longitudinal direction and the movement direction; and an interrelating member, movable in interrelation with movement of the movable member, said process cartridge being detachably mountable to the image forming apparatus at the mounting portion and comprising:

a photosensitive member unit including the photosensitive drum; and a developing unit which includes a developing roller actable on the photosensitive drum and which is movable relative to said photosensitive member unit, wherein said developing unit moves relative to said photosensitive member unit so that a distance between a rotation center of the photosensitive drum and a rotation center of the developing roller is decreased with respect to the movement direction by movement of the image when the movable member is moved from the inside to the outside of the main assembly.

8. A process cartridge according to claim 7, further comprising:

a first side cover provided in one end side of said photosensitive member unit with respect to a longitudinal direction of the photosensitive drum; and a second side cover provided in the other end side of said photosensitive member unit with respect to the longitudinal direction, wherein said developing unit is moved relative to said photosensitive member unit by being guided by guiding portions provided on said first and second side covers.

9. A process cartridge according to claim 7, wherein a cross-sectional area thereof perpendicular to a dismounting direction in which said process cartridge is dismounted from the mounting portion is made smaller than that before movement by moving said developing unit relative to said photosensitive member unit so that the distance between the rotation center of the photosensitive drum and the rotation center of the developing roller is decreased with respect to the movement direction.

10. A process cartridge according to claim 7, wherein said developing unit includes a portion-to-be-engaged, engageable with the interrelating member, for being moved by the interrelating member.

11. A process cartridge according to claim 7, wherein said developing unit includes a grip portion, in a downstream side of a dismounting direction in which said process cartridge is dismounted from the mounting portion, for gripping said process cartridge.

* * * * *